US010344447B2

(12) United States Patent
Sauve et al.

(10) Patent No.: US 10,344,447 B2
(45) Date of Patent: Jul. 9, 2019

(54) CLOSURE SYSTEMS, DEBRIS CAPS, HOLDER DEVICES, AND RELATED TECHNOLOGIES

(71) Applicant: TiteLids, Inc., Everett, WA (US)

(72) Inventors: Chad Sauve, Everett, WA (US); Kevin Richardson, Everett, WA (US)

(73) Assignee: TiteLids, Inc., Everett, WA (US)

( * ) Notice: Subject to any disclaimer, the term of this patent is extended or adjusted under 35 U.S.C. 154(b) by 0 days.

(21) Appl. No.: 15/592,099

(22) Filed: May 10, 2017

(65) Prior Publication Data

US 2017/0328024 A1 Nov. 16, 2017

Related U.S. Application Data

(60) Provisional application No. 62/334,131, filed on May 10, 2016.

(51) Int. Cl.
*E02D 29/00* (2006.01)
*E02D 29/14* (2006.01)

(52) U.S. Cl.
CPC ..... *E02D 29/1409* (2013.01); *E02D 29/1427* (2013.01); *E02D 29/1445* (2013.01); *E02D 2200/1685* (2013.01); *E02D 2300/0001* (2013.01); *E02D 2300/0006* (2013.01); *E02D 2300/0031* (2013.01);
(Continued)

(58) Field of Classification Search
CPC ..... E02D 29/1409; E02D 29/1427; E02D 29/1445; E02D 22/1685; E02D 2300/0001; E02D 2300/0006; E02D 2300/0031; E02D 2300/0035; E02D 2300/0071; E02D 2450/00
USPC ..... 404/25, 26; 52/19; 138/89, 90; 277/646
See application file for complete search history.

(56) References Cited

U.S. PATENT DOCUMENTS 3,712,009 A * 1/1973 Campagna ..... E02D 29/14 404/25
4,060,100 A 11/1977 Miller et al.
(Continued)

FOREIGN PATENT DOCUMENTS

CH 696911 A5 1/2008
CH 700489 9/2010
(Continued)

OTHER PUBLICATIONS

International Search Report and Written Opinion of counterpart International Application No. PCT/US2017/032027; dated Aug. 21, 2017; 26 pages.

*Primary Examiner* — Raymond W Addie
(74) *Attorney, Agent, or Firm* — Perkins Coie LLP

(57) ABSTRACT

A cap assembly can include a cap holder device with a plug member and a cap holder. The cap holder device is positionable in an end of a conduit positioned along a roadway. The cap holder is carried by the plug member and includes a magnetic element and a connector. The connector is connectable to the magnetic element to the plug member such that the magnetic element is movable relative to the plug member so as to position the magnetic element for releasably holding a cap that covers the end of the conduit when the plug member is positioned in the conduit. The cap assembly can be a debris cap insertable in a conduit, an end of a pipe, or other opening.

40 Claims, 21 Drawing Sheets

(52) U.S. Cl.
CPC ..... *E02D 2300/0035* (2013.01); *E02D 2300/0071* (2013.01); *E02D 2450/00* (2013.01)

(56) References Cited

U.S. PATENT DOCUMENTS

| | | | | | |
|---|---|---|---|---|---|
| 4,323,329 | A * | 4/1982 | Chlad | B66C 1/06 | 294/65.5 |
| 4,360,041 | A * | 11/1982 | Hagan | F16L 45/00 | 137/247.43 |
| 4,706,834 | A | 11/1987 | Farney et al. | | |
| 4,919,564 | A * | 4/1990 | Neathery | E02D 29/14 | 277/648 |
| 5,035,336 | A * | 7/1991 | Schmitz | B66C 1/06 | 212/166 |
| 5,038,829 | A * | 8/1991 | Panella | F16L 55/115 | 138/89 |
| 5,458,435 | A * | 10/1995 | Kohno | B66F 19/005 | 404/25 |
| 5,465,078 | A * | 11/1995 | Jones, Jr. | B03C 1/286 | 184/6.25 |
| 5,601,440 | A | 2/1997 | Richter | | |
| 5,775,702 | A * | 7/1998 | Laeremans | H02G 15/013 | 174/151 |
| 6,164,898 | A * | 12/2000 | Taylor | B66F 19/005 | 212/166 |
| 6,350,081 | B1 * | 2/2002 | Khajavi | E02D 29/1436 | 404/25 |
| 6,682,257 | B1 * | 1/2004 | Zappe | E02D 29/14 | 404/25 |
| 6,767,177 | B2 * | 7/2004 | Opitz | B66C 1/06 | 294/65.5 |
| 6,945,731 | B1 * | 9/2005 | Vait | G09F 17/00 | 116/173 |
| 7,731,451 | B2 * | 6/2010 | Roberts | B66F 19/005 | 404/25 |
| 2003/0150500 | A1 * | 8/2003 | Molina | E03D 11/16 | 138/89 |
| 2009/0060654 | A1 | 3/2009 | Smith | | |
| 2009/0095211 | A1 * | 4/2009 | Johns | B01J 8/0015 | 116/201 |
| 2016/0069482 | A1 * | 3/2016 | Giladi | F16J 15/06 | 277/646 |
| 2016/0138748 | A1 * | 5/2016 | Heaton | F16L 45/00 | 137/381 |

FOREIGN PATENT DOCUMENTS

| | | |
|---|---|---|
| CN | 2780842 Y | 5/2006 |
| CN | 10308845 | 5/2013 |
| DE | 202011109998 | 9/2012 |
| JP | 2004270374 | 9/2004 |
| KR | 101524115 B1 | 6/2015 |

* cited by examiner

CLOSURE SYSTEMS, DEBRIS CAPS, HOLDER DEVICES, AND RELATED TECHNOLOGIES

CROSS-REFERENCE TO RELATED APPLICATION

This patent application claims the benefit of and claims priority to U.S. Provisional Application No. 62/334,131, entitled "CLOSURE SYSTEMS, DEBRIS CAPS, AND HOLDER DEVICES FOR HOLDING CLOSURES" and filed on May 10, 2016, which is incorporated herein in its entirety.

TECHNICAL FIELD

The present technology is related to closures, closure holder devices, and associated methods of using the same. In particular, the present technology is related to debris caps and holder devices for magnetically holding debris caps.

BACKGROUND

Waste and water companies and municipalities often install buried components accessible from roadways. Buried valves, pipes, and lines are often accessed via access pipes that extend downwardly from street surfaces. Removable debris caps at the ends of the access pipes protect the buried components from dirt, rocks, debris, and water. To operate a buried valve, a debris cap can be removed from an access pipe, and a tool can be inserted into the open access pipe to engage the valve. The tool can then be used to open or close the valve (e.g., gas valves, water valves, etc.) to, for example, isolate breaks in mains. Removable caps often cover the access ports and pipes for other systems, such as sewer systems and other municipal systems.

Debris caps are often generally flush with surrounding surfaces. Unfortunately, debris caps are not securely held to the ends of the access pipes and are frequently damaged and/or dislodged. For example, debris caps may turn upside down or pop off completely and can cause damage to vehicles traveling along the roadway. If a debris cap pops off from an end of an access pipe located along a crosswalk or a sidewalk, an individual may inadvertently step into the open end of the access pipe and sustain injuries. Additionally, debris, water, and other contaminates can fall through the access pipe and can damage and/or impair operation of buried parts.

SUMMARY

At least some embodiments are a closure system with a holder device that is installable in an open end of a conduit and configured to releasably hold a closure. The holder device can include one or more magnetic elements for magnetically coupling to the closure when the holder device is installed in, for example, an opening. The closure can be, for example, a cap, a lid, or a cover. For example, the closure can be a debris cap configured to be installed along, for example, a roadway, a crosswalk, a sidewall, a driveway, a parking lot, or the like.

The holder device can be installed in a conduit (e.g., a sewer pipe, an access pipe, etc.) to block, seal, or otherwise obstruct a passageway of the conduit and can be adjusted to position the closure at different heights. This allows the coupling device and closure to be installed in a wide range of locations. A magnetic force between the holder device and the closure can be strong enough to prevent the closure from inadvertently popping off the end of the conduit. For example, the force required to pull the holder device out of the conduit can be greater than the force required to separate the closure and the holder device. As such, the closure can be separated from the holder device while the holder device remains installed in the conduit. The closure can be a ferromagnetic cap or magnetic disc configured to cover the end of the conduit while being magnetically coupled to the magnetic element.

In some embodiments, a holder device can include a magnetic holder, a member (e.g., a plug member, a sealing member, etc.), and a positioner. When the member is positioned in a conduit, the positioner can be used to raise or lower the magnetic holder couple to a closure. The positioner can also be used to reconfigure the holder device before installation and can include, without limitation, one or more nuts, washers, clamps, rods (e.g., threaded rods, unthreaded rods, etc.), or the like. The magnetic holder can be configured to impart at least about 1 $lb_f$ (4.4 N), 5 $lb_f$ (22.2 N), 7.5 $lb_f$ (33.4 N), 10 $lb_f$ (44.5 N), or 20 $lb_f$ (90 N) on the closure (e.g., debris cap, lid, etc.). For example, the magnetic force can be between 1 $lb_f$ and 20 $lb_f$, between 5 $lb_f$ and 20 $lb_f$, or between 7.5 $lb_f$ and 20 $lb_f$. In some embodiments, the closure is a metal debris cap (e.g., a cast iron cap) suitable for installation along a high-traffic area, such as a street or a sidewalk.

In some embodiments, a closure system can be used to cover an opening of a pipe or another opening. The closure system can include a closure that can be magnetically held to limit or avoid unintended closure movement, popping off of the closure, or the like. In one embodiment, the closure system can be used to cover an access pipe at a location susceptible to large amounts of debris, such as along roadways, sidewalks, parking lots, or the like. The closure system can include a closure holding device that is securely held within an end portion of a pipe and can include a magnetic element that magnetically holds a closure against the end of the conduit. In some embodiments, magnetic force for holding the closure can be equal to or greater than 1 $lb_f$ (4.4N), 2 $lb_f$ (8.9N), 3 $lb_f$ (13.3N), 4 $lb_f$ (17.8N), 5 $lb_f$ (22.2N), 10 $lb_f$ (44.5N), 15 $lb_f$ (66.7N), 20 $lb_f$ (89N), or ranges encompassing such forces.

To open the end of the pipe, the closure can be manually pulled away from the closure holding device. The closure holding device can be removed from the conduit such that the passageway of the conduit is unobstructed. When desired, the closure holding device can be reinstalled in the conduit, and the closure can be placed again on the end of the conduit. In this manner, the closure system can be used to conveniently cover and access the conduit. In some embodiments, the closure system can be used to close an access point for accessing buried valves, pipes, etc. When installed, the closure can prevent contaminants or debris from entering the access point. If debris does enter the access point, the closure holding device can include a plug member that obstructs an access path leading to the buried features. Accordingly, the cap and plug assembly can work together to substantially prevent any debris from reaching protected underground features.

In yet other embodiments, a closure assembly installable in a conduit comprises a closure holder device positionable within an end portion of a conduit. The closure holder device can include a plug assembly and a closure holder connected to the plug assembly. The closure holder includes a closure retention element that is movable away from or toward the plug assembly to position the closure retention element such that the closure retention element is magnetically coupled to a closure at the end portion of the conduit. The plug assembly can include one or more annular members (e.g., deformable rings) for contacting the sidewall of the conduit. In one embodiment, the plug assembly can include a compressible plug member movable along a connector of the closure retention element to adjust a relative distance between the plug assembly and an end of the retention element.

In some embodiments, a closure system comprises a cap holder device having a locked state for securing the cap holder device to a conduit and an unlocked state for releasing the cap holder device from the conduit. The cap holder device includes a one-piece or multi-piece plug member and a cap holder carried by the plug member. The cap holder releasably holds a cap that covers an opening of the conduit when the cap holder device is positioned in the conduit. In certain embodiments, the cap holder device includes a magnetic element (e.g., a disk with a magnet, a magnetic disk, etc.) movable relative to the plug member and configured to magnetically hold the cap. The cap holder device can be operated to cause the plug member to move from an unexpanded or delivery configuration to an expanded configuration. The cap holder device in the locked state is configured to keep the plug member in the expanded configuration. The cap holder device includes a lock assembly that couples together at least two parts of the closure system to prevent collapsing of the plug member. For example, the lock assembly can prevent operation of the cap holder device that would cause the plug member to collapse. For example, a rotatable adjuster can be coupled to the plug member by one or more locks (e.g. pad locks), tagout devices, lockout hasps, combinations thereof, or the like.

DETAILED DESCRIPTION

Specific details of several embodiments of closure systems, closure holder devices, closures, and associated methods are described below. The term "closure" generally refers to caps, lids, covers, and other elements used to cover, block, and/or obstruct an open end of a conduit, an access opening, etc. For example, debris caps can be used to cover an open end of an access pipe. A person skilled in the relevant art will understand that the technology may have additional embodiments and that the technology may be practiced without several details of the embodiments described below with reference to FIGS. 1-27.

Figure 1:
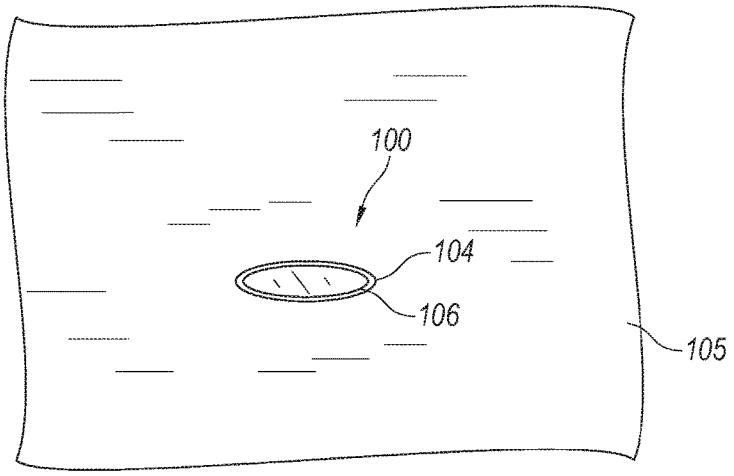
FIG. 1 shows a debris cap positioned at an access opening located along a roadway in accordance with an embodiment of the present technology.

FIG. 1 shows a closure or debris cap assembly 100 ("debris cap assembly 100") positioned at an end of a conduit or pipe 104 ("pipe 104") located along a roadway 105 in accordance with an embodiment of the present technology. The debris cap assembly 100 can include a closure in the form of a cap 106 that is generally flush with an upper surface of the roadway 105. The cap 106 can be magnetically held in place to prevent or limit inadvertent movement. For example, the cap 106 can be held by a magnetic force that is sufficiently strong to prevent or reduce the likelihood of the cap 106 inadvertently being dislodged from the pipe 104. The magnetic force can be overcome to remove the cap 106 from the pipe 104. For example, a person can manually remove the cap 106 to access an underground water shut-off valve, gas shut-off valve, sewer pipe, electrical lines, or the like.

Figure 2:
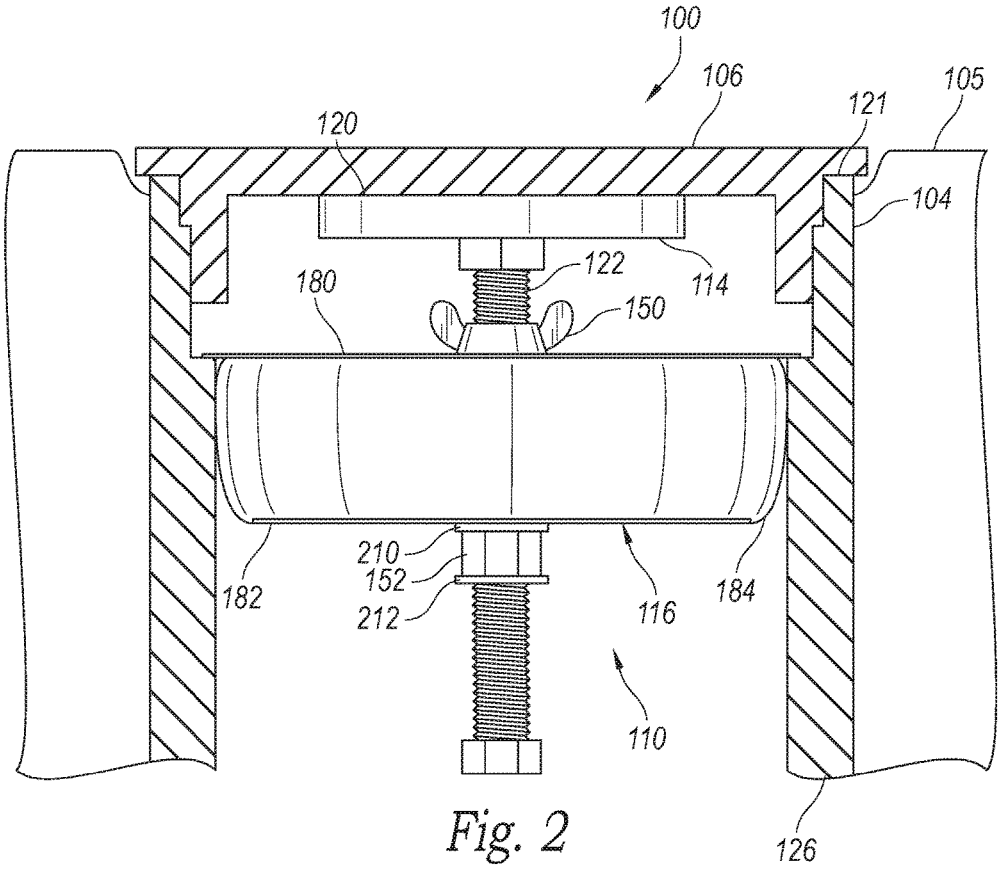
FIG. 2 is a side view of the debris cap and a cap holder device at the access opening of FIG. 1.

FIG. 2 is a side view of the debris cap assembly 100 of FIG. 1. The debris cap assembly 100 can include a cap holder device 110 positioned directly beneath the cap 106 (illustrated in cross section). The cap 106 can be made, in whole or in part, of one or more ferromagnetic materials, such as cast iron. The cap holder device 110 can include a magnetic cap holder 114 ("cap holder 114") and a base or plug assembly 116 ("plug assembly 116"). The cap holder 114 can be raised or lowered relative to the plug assembly 116 to position the cap 106 at a desired height. The cap holder 114 can include a magnetic element 120 for magnetically coupling to the cap 106 and a connector 122 for coupling the magnetic element 120 to the plug assembly 116. The plug assembly 116 engages a sidewall 126 of the pipe 104 (illustrated in cross section) to inhibit, limit, or substantially prevent movement of the cap holder device 110 and, in some embodiments, to seal or block the pipe 104. Pipes, valves, electrical lines, and other components can be located beneath the plug assembly 116.

Figure 3:
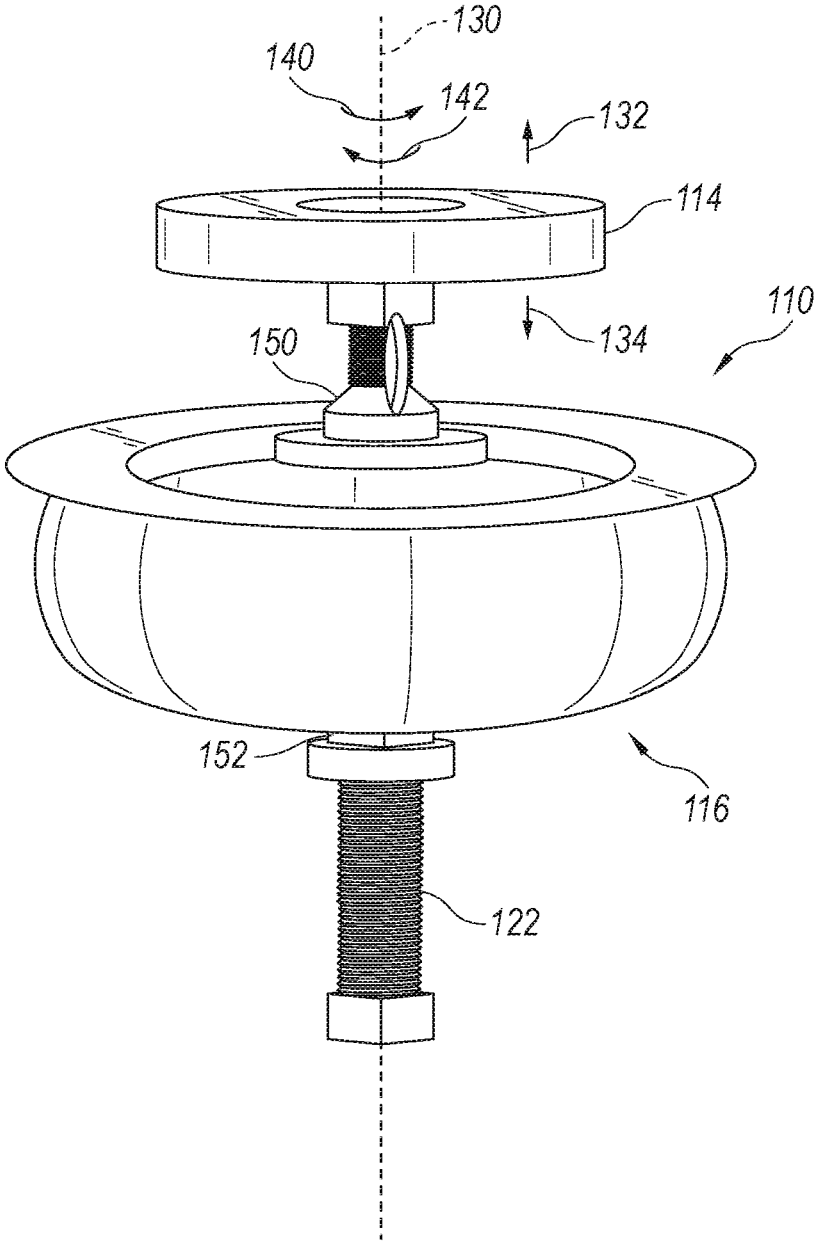
FIG. 3 is an isometric view of a cap holder device in accordance with an embodiment of the present technology.

FIG. 3 is an isometric view of the cap holder device 110 in accordance with an embodiment of the present technology. The connector 122 can define an axis of rotation 130, and the cap holder 114 can be rotated about the axis of rotation 130 in a first direction (indicated by arrow 140) to move the cap holder 114 away from the plug assembly 116 (indicated by arrow 132) and rotated about the axis of rotation 130 in a second direction (indicated by arrow 142) to move the cap holder 114 toward the plug assembly 116 (indicated by arrow 134). In some embodiments, nuts 150, 152 can be used to move the plug assembly 116 along the connector 122. The components and configuration of the cap holder device 110 can be selected based on the desired position of the cap holder 114.

Figure 4:
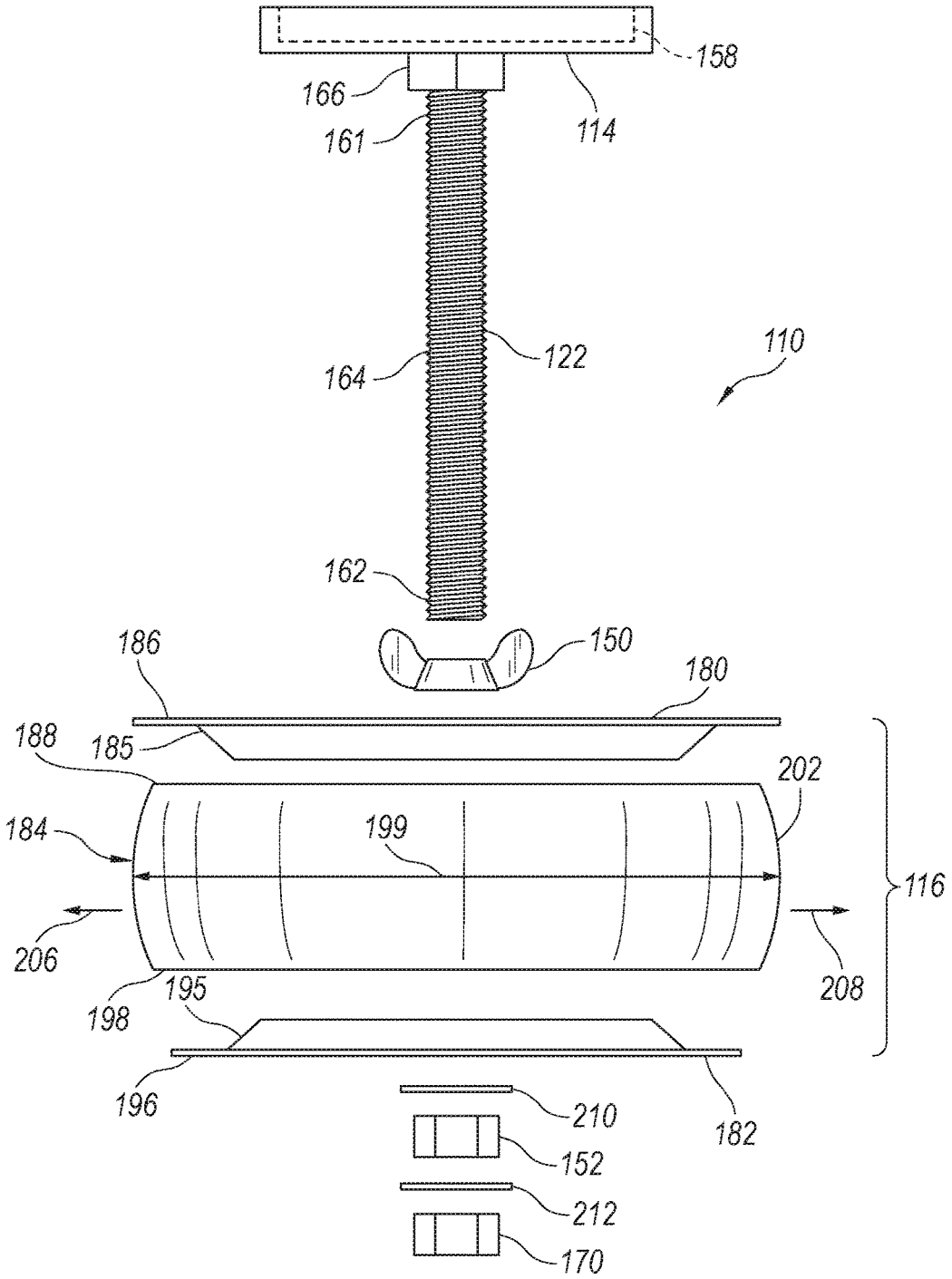
FIG. 4 is an exploded side view of the cap holder device of FIG. 3.

FIG. 4 is an exploded side view of the cap holder device 110. The cap holder 114 can include a single permanent magnet 158 (shown in dashed line) and a magnet holder or another feature for holding the magnet 158. In other embodiments, the magnet 158 can include a plurality of magnets spaced apart from one another. In yet another embodiment, the entire cap holder 114 can be a magnet. The number, position, and characteristics of the magnets (e.g., permanent magnets, electromagnets, etc.) can be selected based on the desired magnetic coupling.

The connector 122 can include a first end 161, a second end 162, and a main body 164 extending therebetween. The first end 161 can be directly or indirectly coupled to the cap holder 114. For example, a coupler 166 can threadably engage external threads of the connector 122 and can include, without limitation, one or more nuts, washers, pins, combinations thereof, or the like. The main body 164 can have external threads configured to engage the nuts 150, 152, 170. In various embodiments, the connector 122 can be a one-piece or multi-piece rod, shaft, or another element for coupling the cap holder 114 to the plug assembly 116.

The plug assembly 116 can include an upper plate 180, a lower plate 182, and a plug or sealing member 184 ("plug member 184"). The upper plate 180 can include a central portion 185 for seating in the plug member 184 and a periphery portion 186 for contacting an upper periphery 188 of the plug member 184. The lower plate 182 can include a central portion 195 for seating in the plug member 184 and a periphery portion 196 for contacting a lower periphery 198 of the plug member 184. In some embodiments, the plates 180, 182 can include one or more pins, protrusions, keying features, or other positioning features. When the plates 180, 182 move toward one another, the plug member 184 can be compressed to push the periphery 202 of the plug member 184 outwardly (indicated by arrows 206, 208). After inserting the plug member 184 into a pipe, the plates 180, 182 can compress the plug member 184 to cause radial expansion of the plug member 184 and thereby secure it to the pipe. The nuts 150, 152 can be used to increase or decrease the pressure applied by the plug member 184.

The plug member 184 can be generally round (as viewed from above) and the diameter 199 can be slightly smaller than, or generally equal to, the inner diameter of a pipe. The diameter 199 can be increased 5%, 10%, 20%, 30%, 40%, or another suitable amount when the plug member 184 is moved from the delivery or unexpanded configuration to the installed or expanded configuration. The plug member 184 can be made, in whole or in part, of rubber, silicon, plastic, or another material suitable for contacting conduits, access openings, or the like, and can have a one-piece or multi-piece construction. In rigid embodiments, the plug member 184 can be made, in whole or in part, of hard rubber, rigid plastic, or metal and can be an annular, cylindrical, or the like. By way of example, the plug member 184 can include an inner metal body and an outer rubber coating. The rubber coating can enhance frictional interaction with an adjacent structure, thereby limiting or inhibiting relative movement between the cap holder device 110 and the structure in which it is installed. The configuration, shape, components, and mechanical characteristics of the plug assembly 116 can be selected based on the installation location.

When the nut 150 (e.g., a wing nut) is rotated to drive the upper plate 180 downwardly, the plug member 184 can be compressed. In other embodiments, the plug member 184 can maintain its shape when compressed between the plates 180, 182. For example, the nuts 150, 152 can be rotated along the connector 122 to position the plug member 184 with respect to the cap holder 114. The washer 210 can help distribute forces against the plate 182. The nut 170 can be used to inhibit or prevent downward movement of the nut 152. A washer 212 is positioned between the nuts 152, 170. The components and configurations of the cap holder device 110 can be selected to achieve desired positioning of the plug member 184, movement of the plug member 184, etc.

Figure 5:
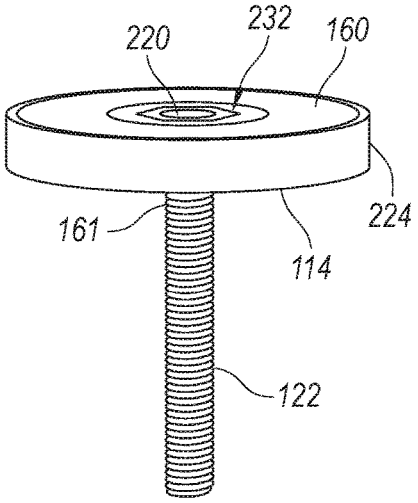
FIG. 5 is an isometric view of a magnetic holder in accordance with an embodiment of the present technology.
Figure 6:
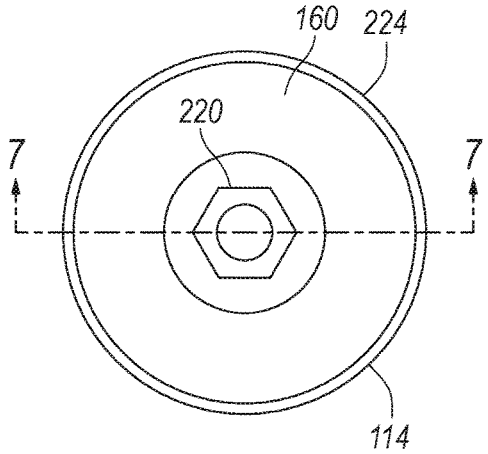
FIG. 6 is a top view of the magnetic holder of FIG. 5.
Figure 7:
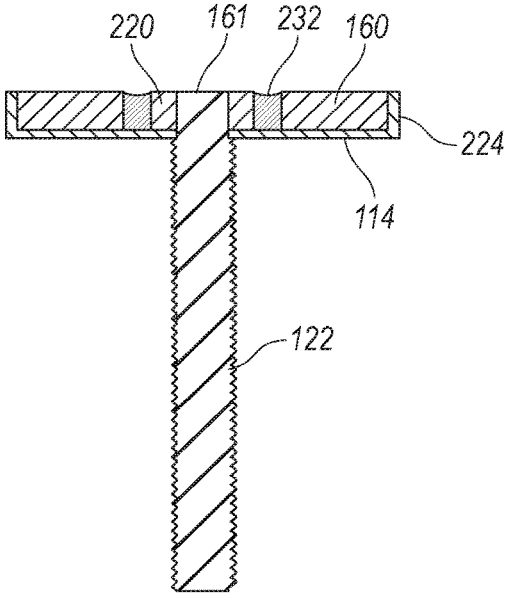
FIG. 7 is a cross-sectional view of the magnetic holder taken along line 7-7 of FIG. 6.

FIG. 5 is an isometric view of the cap holder 114 in accordance with an embodiment of the present technology. FIG. 6 is a top view of the cap holder 114. FIG. 7 is a cross-sectional view of the cap holder 114 taken along line 7-7 of FIG. 6. The cap holder 114 can include a fastener 220, which can be a nut, washer/nut assembly, or another component for coupling the cap holder 114 to the connector 122. In some multi-piece embodiments, the cap holder 114 can include a holder or a casing 224 ("casing 224") and a magnet 160. In FIG. 7, material 232 (e.g., metal, filling material, adhesive, etc.) can lock the fastener 220 to the cap holder 114. In other embodiments, the end 161 can be welded or otherwise directly coupled to the cap holder 114.

Figure 8:
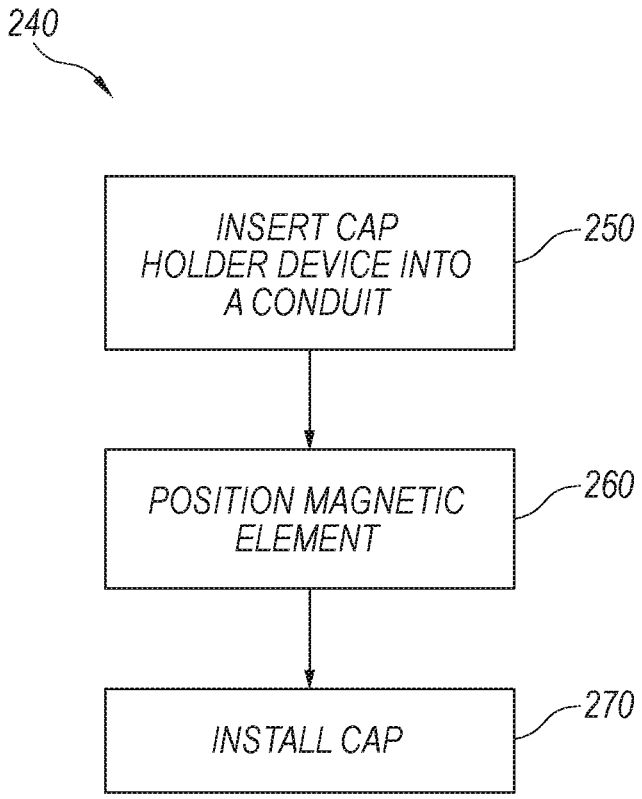
FIG. 8 is a flow chart illustrating a method for installing a closure system.

FIG. 8 is a flow chart illustrating a method 240 for installing a closure system. At block 250, a cap holder device can be inserted into an end of a conduit. A plug member can be moved along a passageway of the conduit until the cap holder device is at a desired depth. At block 260, a cap holder device can be reconfigured to position a magnetic element and/or plug members. At block 270, a cap can be installed on the end of the conduit. The method 240 is discussed below in connection with FIGS. 9-12.

Figure 9:
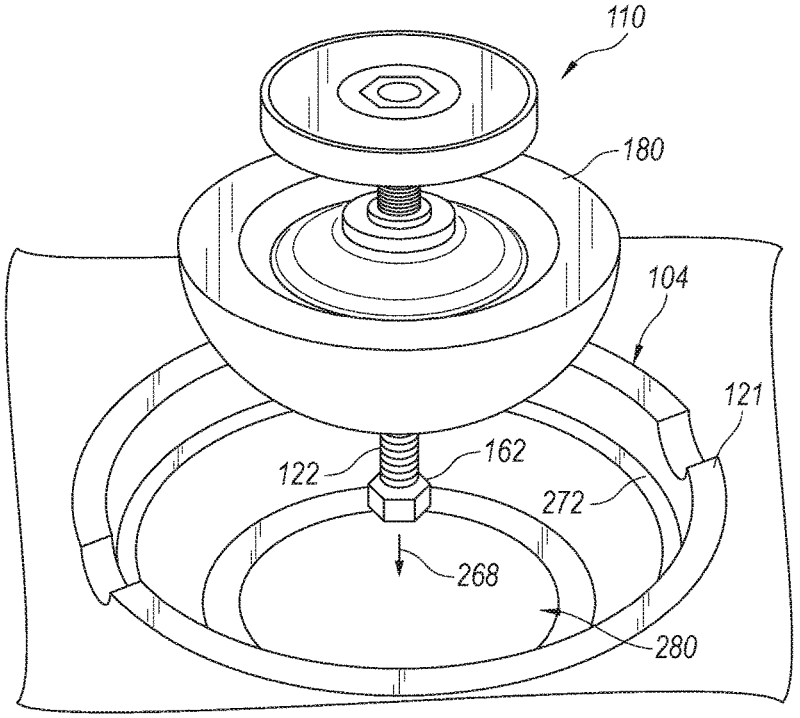
FIGS. 9-12 show various stages of a method for installing a closure system in accordance with an embodiment of the technology.

FIG. 9 shows the cap holder device 110 ready to be installed in the end 121 of the conduit 104. The cap holder device 110 can be generally centered with respect to the conduit passageway 280 and then inserted into the conduit 104, as indicated by arrow 268. The upper plate 180 can seat on a shoulder 272 of the pipe 104.

Figure 10:
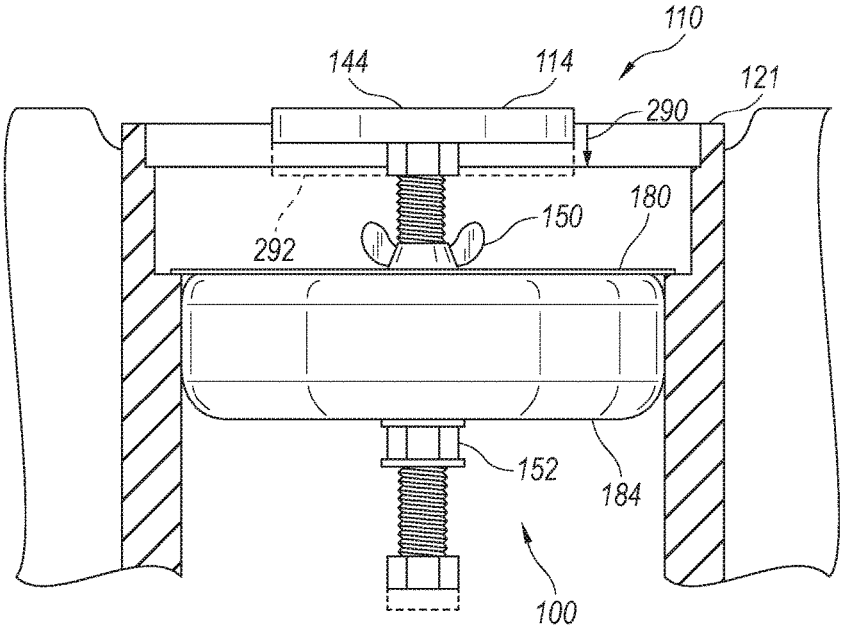

FIG. 10 shows the cap holder device 110 positioned in the conduit end 121 (shown in cross section), and the nuts 150, 152 can be used to adjust the position of the cap holder 114. Additionally or alternatively, the cap holder 114 can be rotated to raise or lower the magnetic element 144. For example, the cap holder 114 can be rotated to lower the cap holder 114 (indicated by arrow 290) to a cap holding position 292 (illustrated in dashed line).

Figure 11:
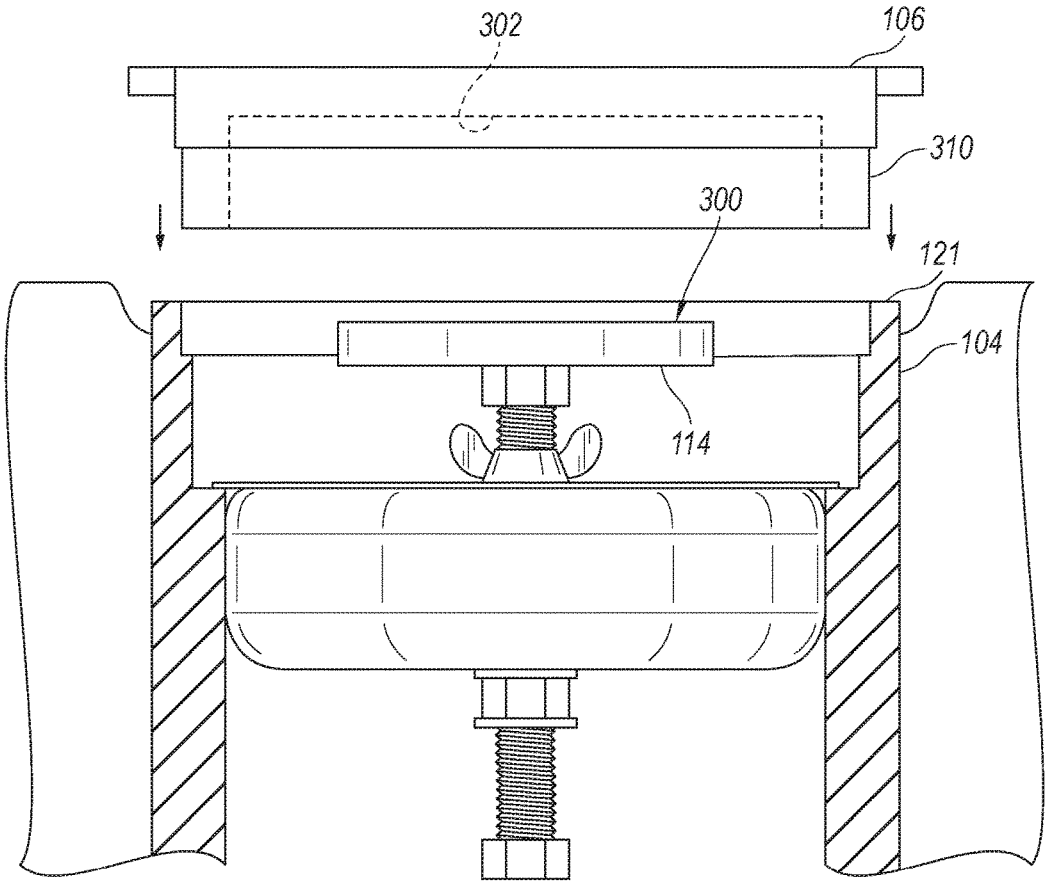

FIG. 11 shows the cap 106 ready to be installed. An upper surface 300 of the cap holder 114 can be positioned to be close to, or to contact, a lower surface 302 (shown in dashed line) of the cap 106. To install the cap 106, a tubular portion 310 of the cap 106 can be inserted into the open conduit end 121 such that the lower surface 302 moves toward the upper surface 300 of the cap holder 114.

Figure 12:
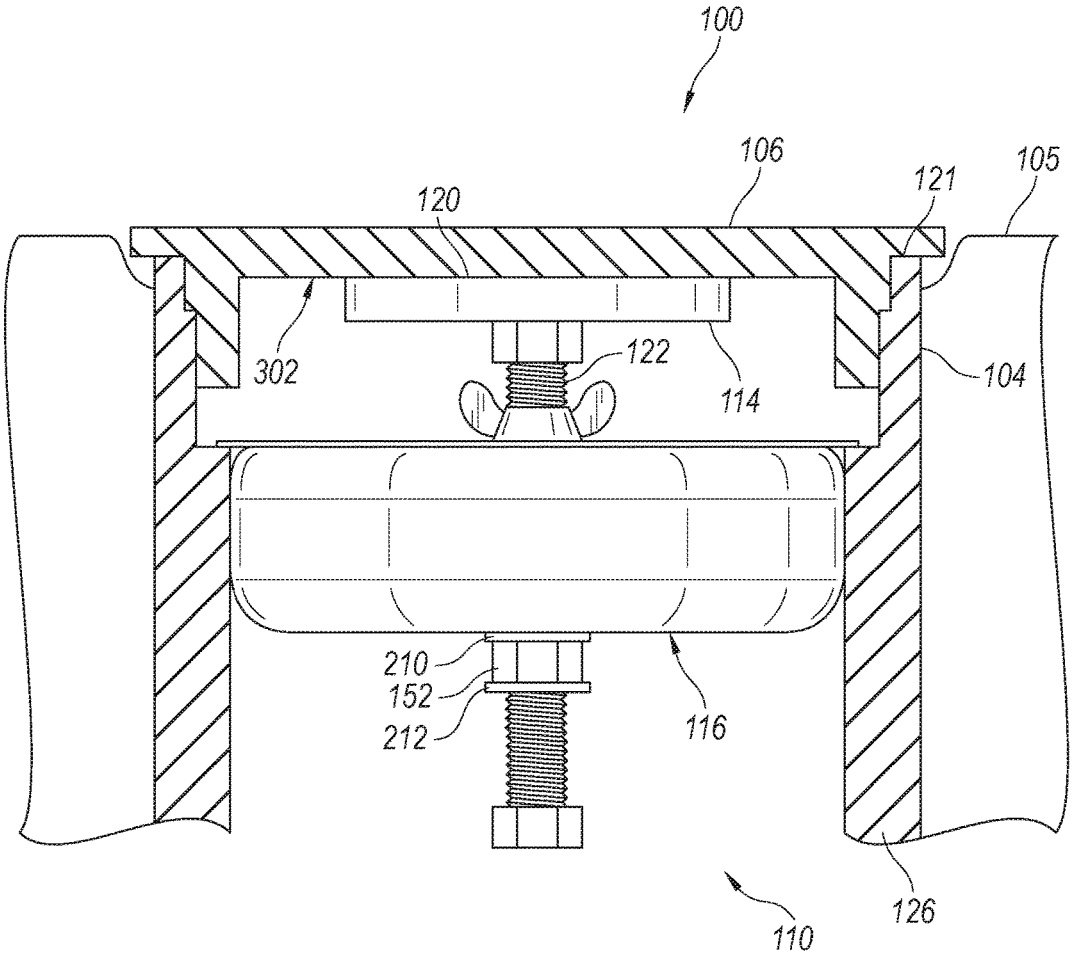

FIG. 12 shows the cap 106 magnetically coupled to the cap holder 114. The magnetic element 120 can be close to or in physical contact with the bottom surface 302 to hold or draw the cap 106 downward. The force required to separate the cap 106 and the magnetic element 120 can be equal to or greater than 1 pound force (4.4N), 2 pound force (8.9N), 3 $lb_f$ (13.3N), 4 $lb_f$ (17.8N), 5 $lb_f$ (22.2N), 10 $lb_f$ (44.5N), 15

$lb_f$ (66.7N) 20 $lb_f$ (89N), or ranges encompassing such forces. A user can remove the cap 106 by overcoming the magnetic coupling provided by the cap holder device 110 can then manually lift the cap holder device 110 from the conduit 104 to access, for example, shutoff valves, lines, or the lower passageway of the conduit 104. The cap holder device 110 can then be replaced into the conduit 104, and the cap 106 can be reinstalled to once again seal the conduit 104.

The cap 106 can be made, in whole or in part, of one or more ferromagnetic materials, such as iron, iron alloys, or the like. In one embodiment, the cap 106 can be a cast iron cap. Although the magnetic element 120 is discussed as being a magnetic element, it can also be a non-magnetic element. In one non-magnetic embodiment, the cap holder 114 comprises mostly or entirely one or more ferromagnetic materials. For example, the cap holder 114 can be a disc made, in whole or in part, of iron or iron alloys, and the cap 106 can include one or more magnets positioned on or embedded within the lower surface 302.

Figure 13:
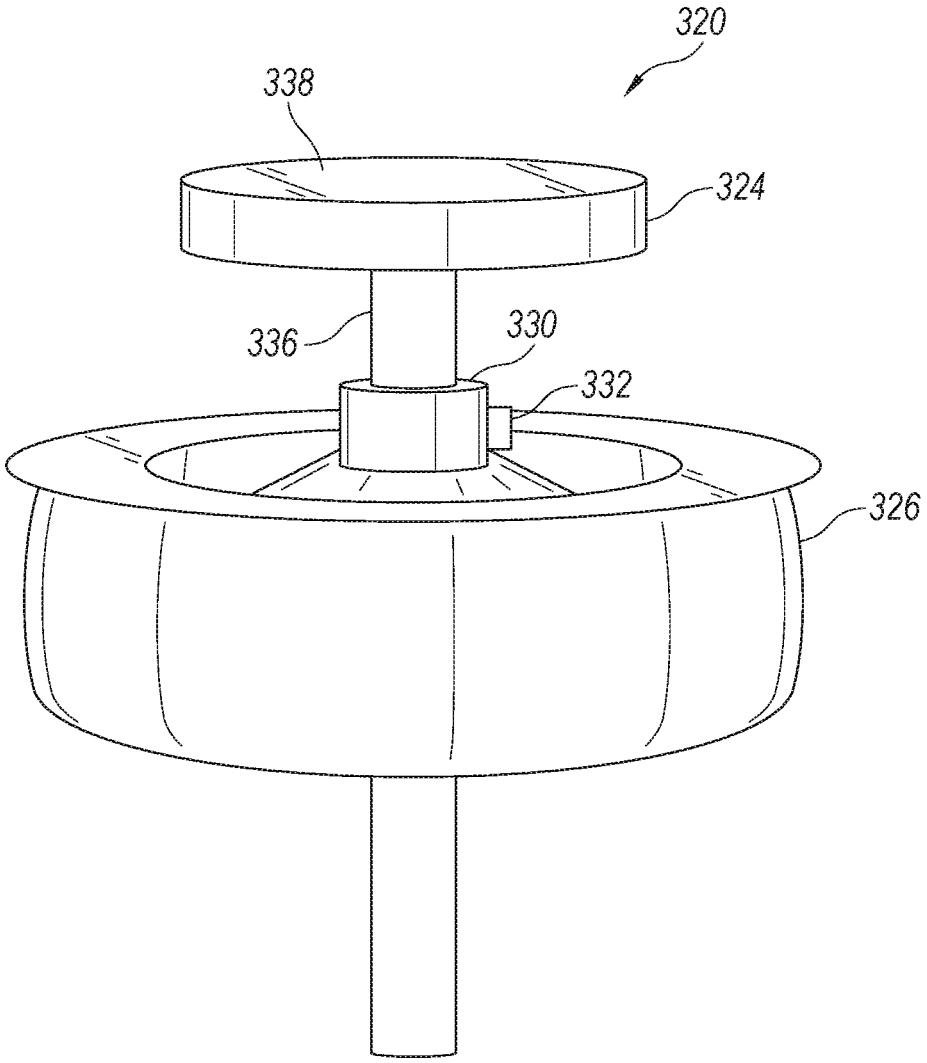
FIG. 13 is an isometric view of the cap holder device in accordance with another embodiment of the present technology.

FIG. 13 is an isometric view of a cap holder device 320 in accordance with another embodiment of the present technology. The description of the cap holder device 110 discussed in connection with FIGS. 2-12 applies equally to the cap holder device 320, except as detailed below. The cap holder device 320 can include a cap holder 324, a base or plug assembly 326 ("plug assembly 326"), and a positioner device 330. The cap holder 324 can include a threaded or unthreaded connector 336 and a coupling element 338, such as a magnetic element, a ferromagnetic disk, or the like.

The positioner device 330 can include an element 332 (e.g., a button, a lever, etc.) for changing the positioner device 330 from a locked state to an unlocked state. When the positioner device 330 is unlocked, the cap holder 324 can be moved (e.g., rotated and/or translated) relative to the plug assembly 326. When the positioner device 330 is locked, the cap holder 324 can be securely fixed with respect to the plug assembly 326. In some installation procedures, a user can install the plug assembly 326 while the positioner device 330 is in an unlocked state. After installing the plug assembly 326, the user can manually raise or lower the cap holder 324 until it is at the desired height. The user can then operate the element 332 to lock the cap holder 324. If the cap is replaced with another cap, the element 332 can be used to reconfigure the cap holder device 320 for use with the replacement cap, thereby providing flexibility in the field without replacing the cap holder device 320.

With continued reference to FIG. 13, the connector 336 has external threads that engage internal threads of the positioner device 330. When the positioner device 330 is unlocked, the cap holder 324 can be rotated to move the coupling element 338 away from or toward the plug assembly 326. In other embodiments, the connector 336 can be unthreaded. When the positioner device 330 is unlocked, the connector 336 can be translated (with or without rotation) through the positioner device 330. The positioner device 330 can include, without limitation, one or more pins, stops, magnets, or the like.

Figure 14:
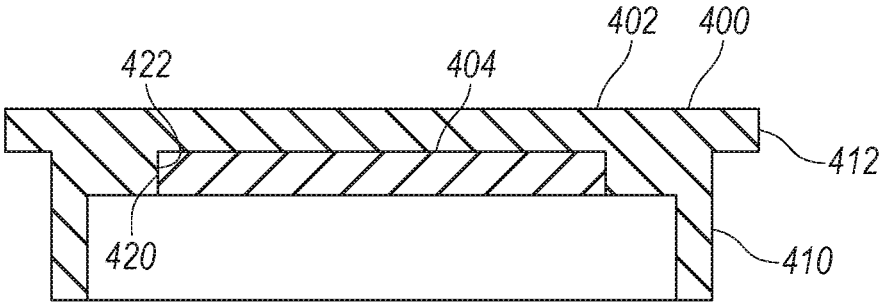
FIGS. 14 and 15 are cross-sectional views of debris caps in accordance with embodiments of the present technology.
Figure 15:
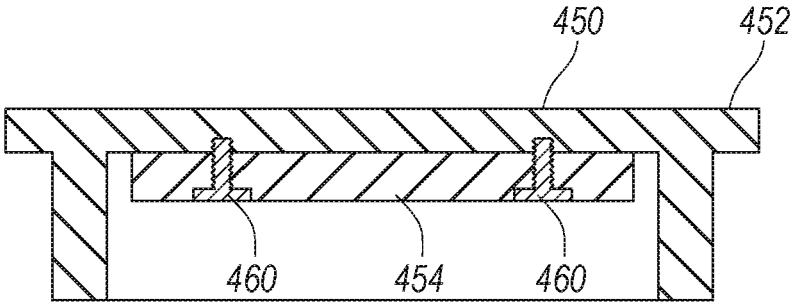

FIGS. 14 and 15 are cross-sectional views of closures in accordance with various embodiments of the technology. Generally, the closures can be used with the holder devices discussed herein, and the description of the cap 106 of FIGS. 1-11 applies equally to the closures of FIGS. 14 and 15, except as detailed below.

FIG. 14 is a cross-sectional side view of a cap 400 that includes a main body 402 and a coupling element 404. The main body 402 can include a cylindrical section 410 and a lip or protrusion 412. The cylindrical section 410 can be inserted into an opening, an end of a conduit, or the like such that the lip or protrusion 412 seats against a cutout, a lip, a rim, or another feature. The main body 402 can be made, in whole or in part, of metal (e.g., iron, cast iron, steel, aluminum, etc.), plastic, rubber, or combinations thereof. The coupling element 404 can be, for example, a magnetic element, a ferromagnetic element, or the like and can have a periphery 420 with external threads for threadably engaging internal threads 422 of the main body 402. The coupling element 404 can be rotated to remove it from the main body 402 and can be replaced with another threaded coupling element. In other embodiments, the coupling element 404 can be coupled to the main body 402 by, for example, adhesives, welds, fasteners, clips, or the like. In some lightweight embodiments, the main body 402 can be made of a generally light material, such as lightweight plastic. The coupling element 404 can be either a ferromagnetic element for coupling to a magnet of a holder device, or a magnet for coupling to a ferromagnetic element of the holder device.

FIG. 15 is a cross-sectional side view of a cap 450 that includes a main body 452 and a coupling element 454. Fasteners 460 can couple to the coupling element 454 (e.g., a magnet, ferromagnetic element, etc.) to the main body 452 and can be bolts, screws, nut and bolt assemblies, or the like.

Figure 16:
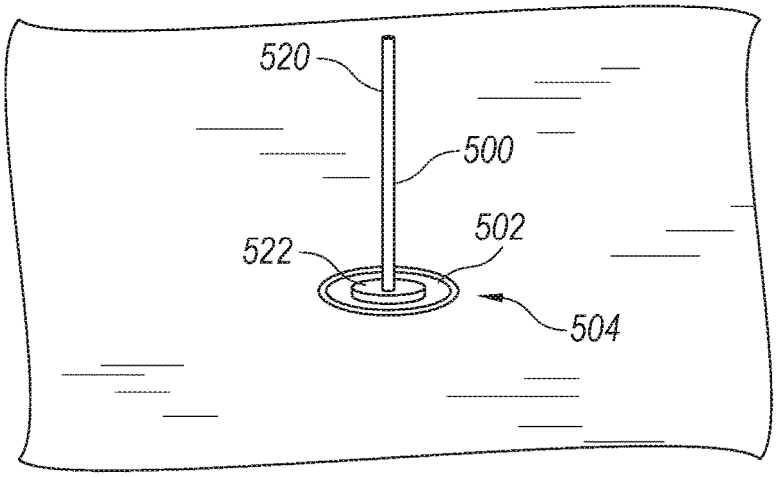
FIG. 16 is an isometric view of a removal tool engaging a closure.
Figure 17:
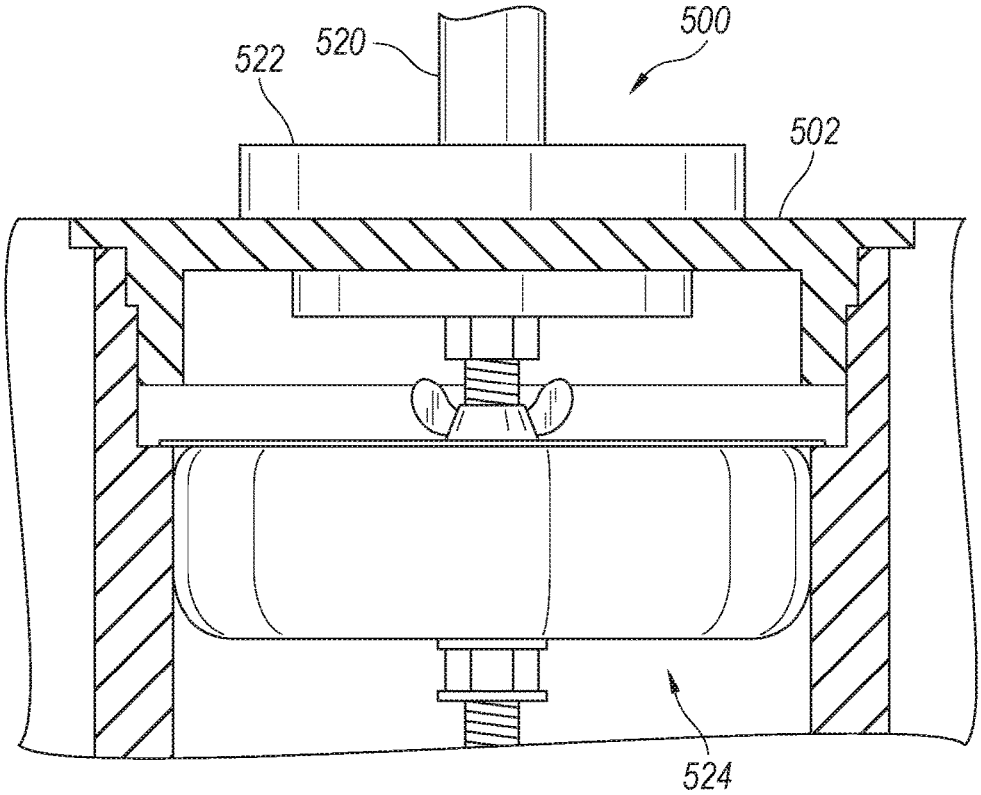
FIG. 17 is a detailed partial cross-sectional view of a coupling element of the removal tool coupled to the closure.

FIG. 16 is an isometric view of a removal tool 500 for removing a cap 502 of a debris cap assembly 504. FIG. 17 is a detailed view of the removal tool 500 coupled to the cap 502. It may be difficult to remove the debris cap manually from the pipe, especially if dirt or other debris has accumulated around the cap 502 or interfaces. A user can stand next to a cap 502 and place the removal tool 500 on the upper surface of the cap 502. The user can then lift the removal tool 500, which is carrying the cap 502, to remove the cap 502 to access the debris cap assembly 504.

The removal tool 500 can include a handle 520 and a coupler 522. The handle 520 can be made, in whole or in part, of wood, metal, or other suitable material. In some embodiments, the coupler 522 can include a magnet capable of magnetically holding the cap 502 and can be stronger than the magnet of the debris cap assembly 524 such that the coupler 522 is capable of breaking the magnetic coupling between the cap 502 and the underlying debris cap assembly 504. In other embodiments, the coupler 522 can include one or more coupling features (e.g., hooks, pins, clips, rods, mechanical engagement features, etc.) that can be received by one or more openings, rings, or other features of the cap 502.

Figure 18:
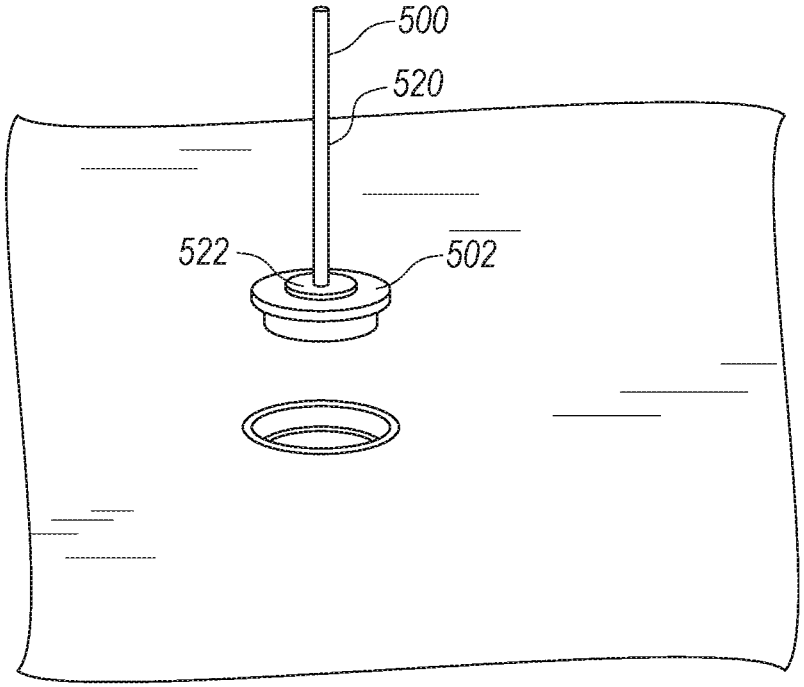
FIG. 18 shows the removable tool carrying the closure.

In operation, the user can place the coupler 522 on the upper surface of the lid. The user can use the handle 520 to lift up the removal tool 500 and the cap 502 attached thereto. When the user lifts up on the handle 520, the cap 502 can be raised away from an opening, as shown in FIG. 18. The user can use the removal tool 500 to reinstall the cap 502 or another closure.

Figure 19:
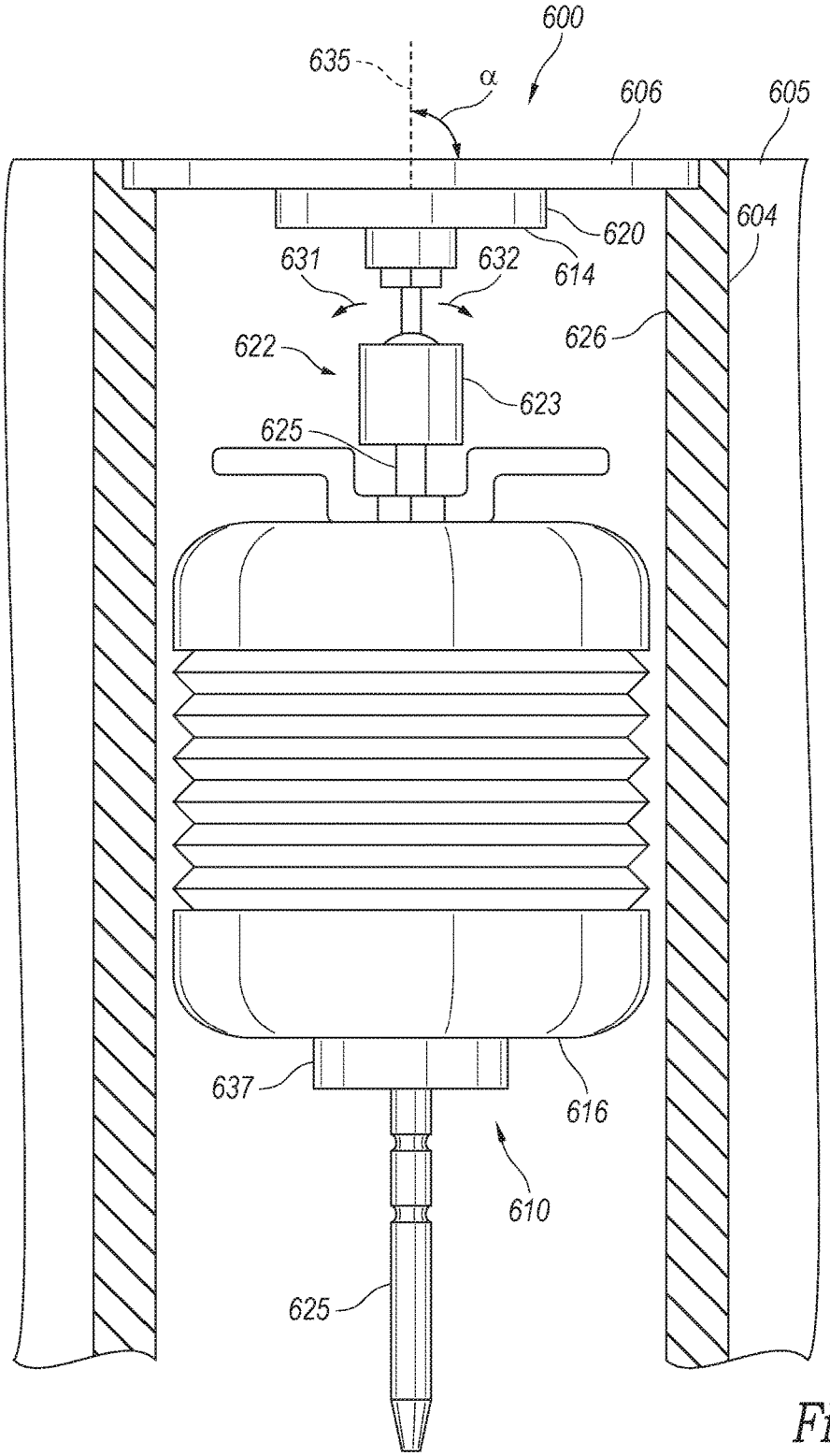
FIG. 19 is a side view of a closure system installed in accordance with an embodiment of the present technology.

FIG. 19 is a side view of the installed closure system in accordance with an embodiment of the present technology. A closure or debris cap assembly 600 ("debris cap assembly 600") is positioned at an end of a conduit or pipe 604 ("pipe 604"). The debris cap assembly 600 can include a cap 606 and a cap holder device 610. The cap holder device 610 can magnetically hold the cap 606 generally flush with a surrounding surface 605. The magnetic force can be overcome to remove the cap 606 and to access the debris cap assembly 600.

The cap holder device 610 can include a magnetic cap holder 614 ("cap holder 614") and a base or plug assembly 616 ("plug assembly 616"). The cap holder 614 can include a magnetic element 620 for magnetically coupling to the cap 606 and a connector 622 for coupling the magnetic element 620 to the plug assembly 616. The connector 622 can include a joint 623 and a shaft 625. The joint 623 allows movement (indicated by arrows 631, 632) of the magnetic element 620 relative to the plug assembly 616. Although the illustrated cap 606 is generally perpendicular to a longitudinal axis 635 of the closure system or pipe 604, the articuiatable cap holder 614 can securely hold the cap 606 at other orientations for installation flexibility. For example, an angle $\alpha$ defined by the cap 606 and the longitudinal axis 635 can be in a range of about 160° to about 20°, about 140° to about 40°, about 120° to about 60°, or other suitable ranges.

The plug assembly 616 can engage a sidewall 626 of the pipe 604 (illustrated in cross section) to inhibit, limit, or substantially prevent movement of the cap holder device 610 and, in some embodiments, to seal or block the pipe 604. When a locking mechanism 637 is locked, it securely holds the shaft 625 such that the cap holder 614 is fixed at a set height. When the locking mechanism 637 is unlocked, it allows the shaft 625 to be moved vertically to raise or lower the cap holder 614 relative to the plug assembly 616.

Figure 20:
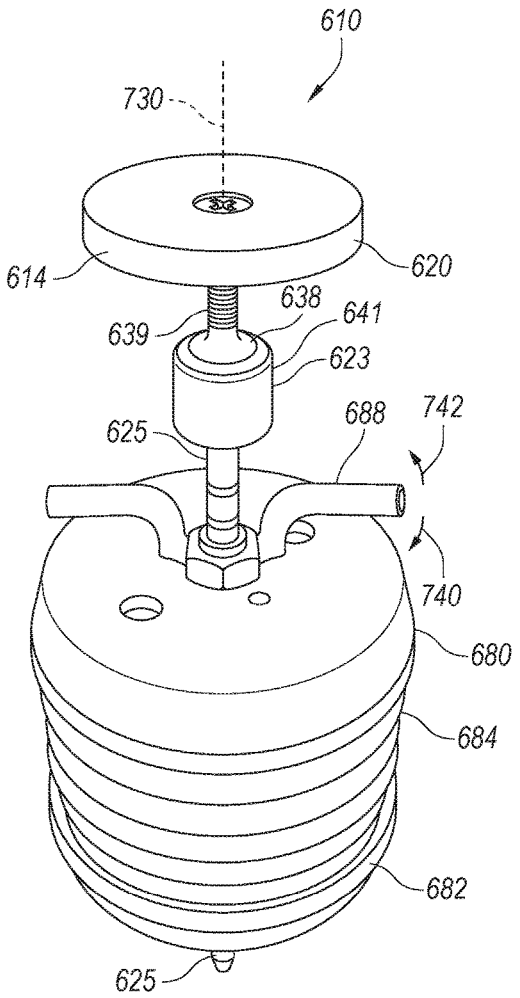
FIG. 20 is a front, top isometric view of a cap holder device in accordance with an embodiment of the present technology.
Figure 21:
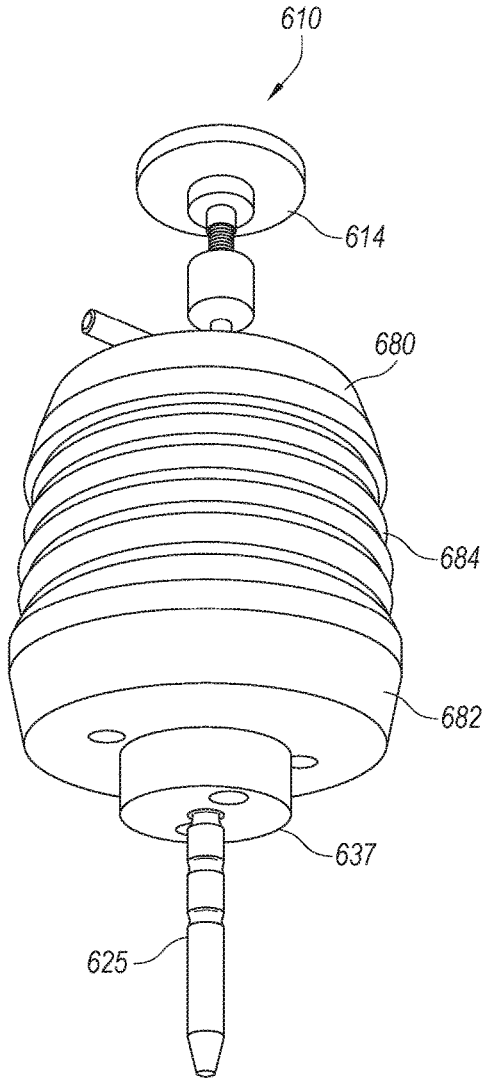
FIG. 21 is a front, bottom isometric view of the cap holder device of FIG. 20.

FIG. 20 is a front, top isometric view of the cap holder device 610 in accordance with an embodiment of the present technology. FIG. 21 is a front, bottom isometric view of the cap holder device 610. Referring now to FIG. 20, the cap holder 614 can include an elongate connector 639 that connects the magnetic element 620 to the joint 623. The joint 623 can include one or more ball and socket joints, collar and socket joints, hinges, or other elements that allow movement of the magnetic element 620. In one embodiment, the joint 623 is a ball and socket joint that includes a ball 638 and a socket 641. The ball 638 can be connected to the elongate body 639, and the socket 641 can be connected to the shaft 625. The configuration of features connecting elements can be selected based on the desired functionality.

The plug assembly 610 can include an upper plate 680, a lower plate 682, and a plug or sealing member 684 ("plug member 684"). An adjuster 688 can be rotated about an axis of rotation 730 in a first direction (indicated by arrow 740) to move the upper plate 680 toward the lower plate 682 to compress the plug member 684. As the plug member 684 is compressed, it bulges outwardly to form a seal or otherwise engage the conduit. The amount of bulging can be adjusted to control the pressure applied to the conduit. The adjuster 688 can be rotated about the axis of rotation 730 in a second direction (indicated by arrow 742) to move the upper plate 680 away from the lower plate 682. As the upper and lower plates 680, 682 move away from each other, the plug member 684 can return to its original configuration, which can be a non-bulging configuration, cylindrical configuration, or other suitable configuration.

Referring now to FIG. 21, when the locking mechanism 637 is in a locked state, it can be fixedly coupled to the shaft 625 to prevent downward movement of the plate 682. This enables compression of the plug member 684. When the locking mechanism 637 is in an unlocked state, the shaft 625 can be moved relative to the locking mechanism 637. Movement of the cap holder 614 is discussed in connection with FIGS. 24-26.

Figure 22:
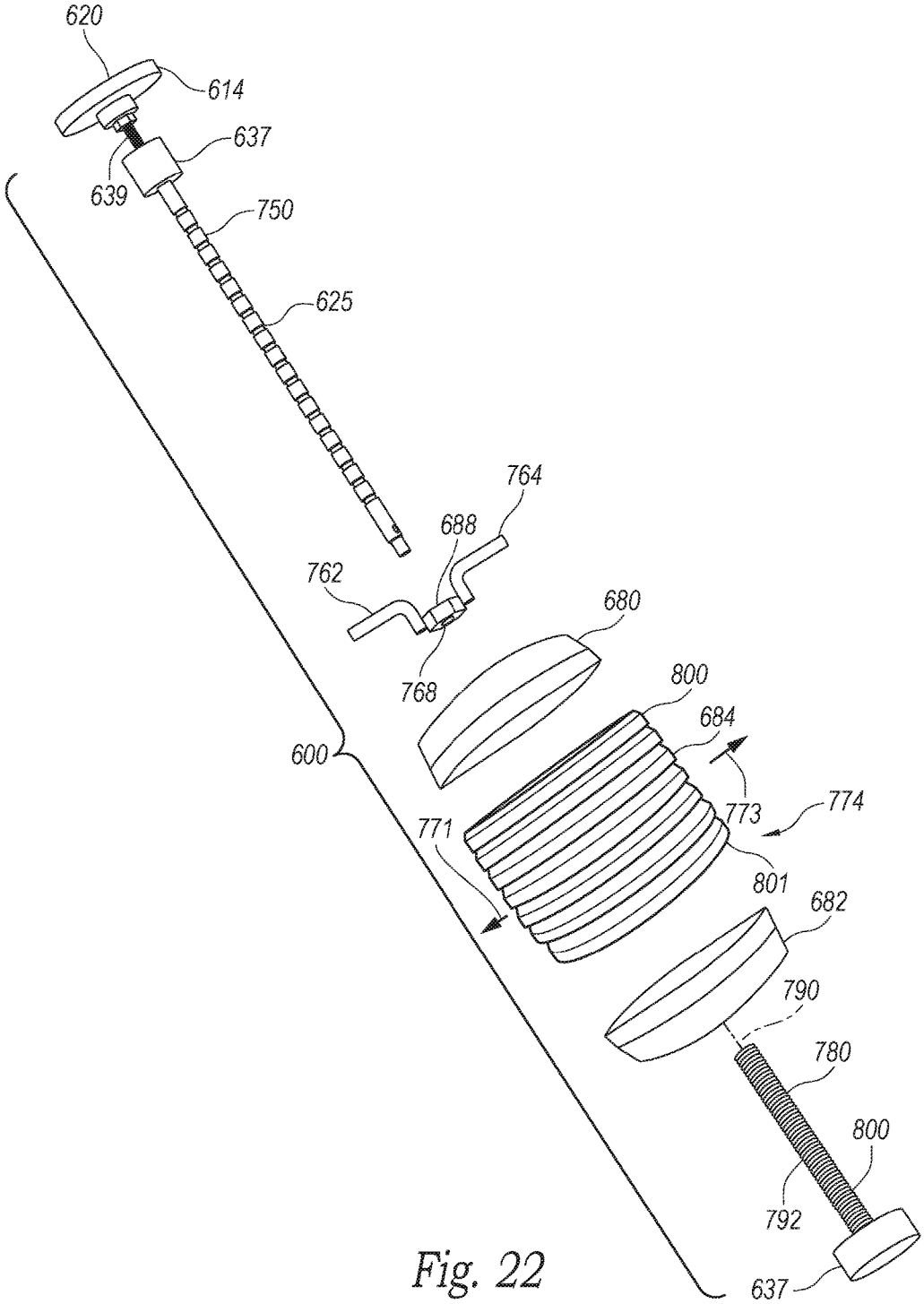
FIG. 22 is an exploded view of a cap holder device in accordance with an embodiment of the present technology.

FIG. 22 is an isometric exploded view of the debris cap assembly 600 in accordance with an embodiment of the technology. The joint 637 can be permanently coupled to the magnetic element 620 by the elongate element 639. In other embodiments, the joint 637 can be detachably coupled to the magnetic element 620 by one or more fasteners. The shaft 625 can include a plurality of discrete positioning features 750 (one identified in FIG. 22) evenly or unevenly spaced apart from one another along the length of the shaft 625. The positioning features 750 can be annular recesses, ridges, or combinations thereof for interacting with locking mechanism 637.

The adjuster 688 can have handles or arms 762, 764 and a body 768. The body 768 can be configured to engage external threads 780 of the shaft 792. In some embodiments, the adjuster 688 can be a wing nut. The configuration and features of the adjuster 688 can be selected based on desired operation.

The upper plate 680 can be configured to receive an end 800 of the plug element 684. The plate 680 can be made, in whole or in part, of metal, plastic, composites, or other suitable material for engaging the compressed member 684. For example, the plate 680 can comprise stainless steel or plastic to withstand corrosion in humid or wet environments. The configuration and characteristics of the plate 680 can be selected based on the desired compressive forces to be applied to compressed member 684 and environmental setting.

The sealing member 684 can be made, in whole or in part, of rubber, plastic, or other suitable material capable of undergoing deformation. In some embodiments, the sealing member 684 is a cylindrical compliant member made of rubber. When the upper plate 680 and lower plate 682 move towards one another, sealing member 684 can bulge outwardly, as indicated by arrows 771, 773. An exterior surface 774 of the sealing member 684 can include ridges, bumps, texturing, or other features for enhancing frictional interaction with the conduit or the component in which the closure system is installed. The shaft 792 can be sufficiently long to extend through the lower plate 682, sealing member 684, upper plate 680, and nut wing 768. The adjuster 688 can be rotated to be moved upwardly or downwardly along the shaft 792. The locking mechanism 637 can be fixedly coupled to an end 800 of the shaft 792.

The lower plate 682 can have an opening for receiving the shaft 792 and can receive an end 801 of the sealing member 684. The plate 680 can be made, in whole or in part, of metal, plastic, composites, or other suitable material for engaging the compressed member 684. The configuration and characteristics of the plate 682 can be selected based on the desired compressive forces to be applied to compressed member 684 and environmental setting.

A base assembly 790 can include a receiver or tube 780 ("tube 780") and the locking mechanism 637. The tube 780 can have an externally threaded surface 792 and can be coupled to the locking mechanism 637. To assemble the cap assembly 600, the shaft 625 can be inserted through an aperture in the upper plate 680, compressible member 684, lower plate 682, and shaft 780. The shaft 780 can be inserted through the lower plate 682, compressible member 684, and upper plate 680.

Figure 23:
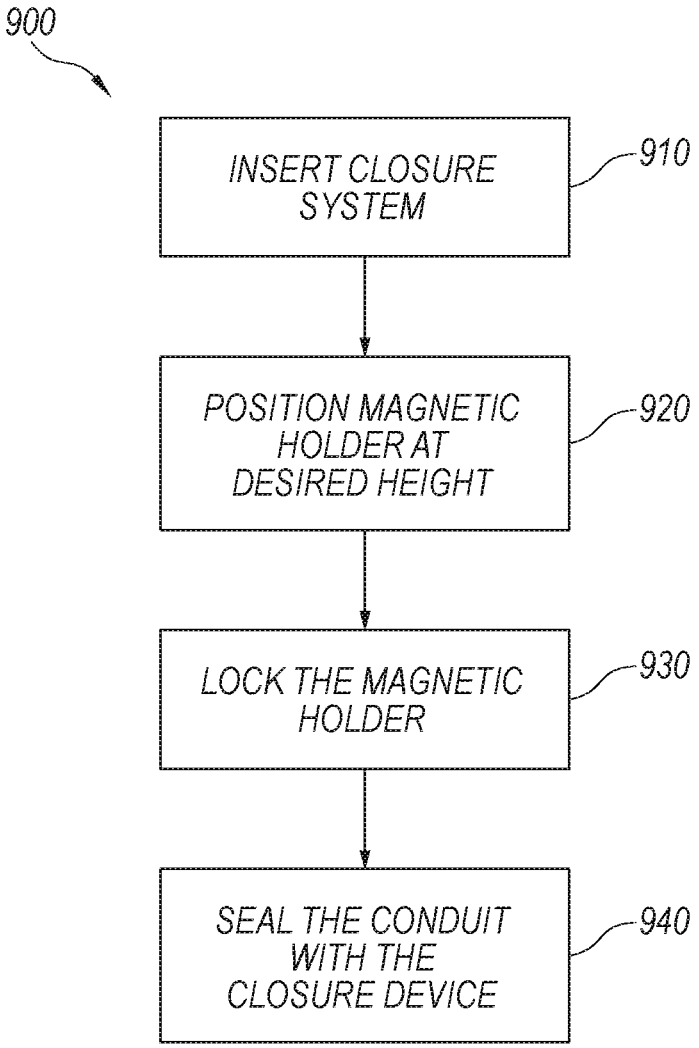
FIG. 23 is a flow chart illustrating a method for installing a closure system.

FIG. 23 is a flow chart illustrating a method 900 suitable for installing closure systems disclosed herein. At block 910, a cap holder device can be inserted into an end of a conduit until the cap holder device is at a desired depth. At block 920, a cap holder device can be reconfigured to position a magnetic element at a desired position. At block 930, the magnetic holder can be locked at the selected position. At block 940, the cap holder device can be expanded to an installed configuration. The method 900 is discussed below in connection with FIGS. 24-26.

Figure 24:
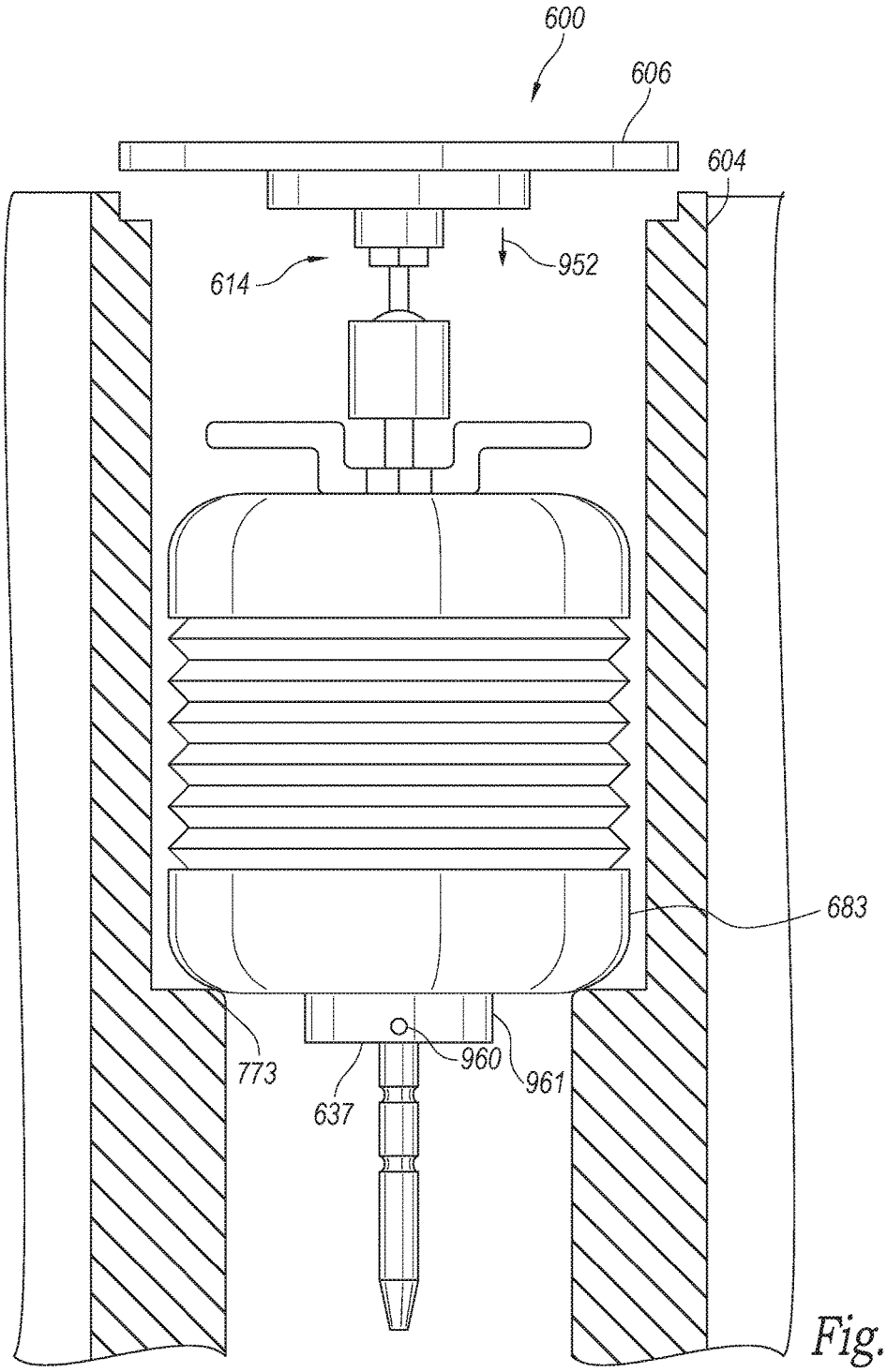
FIGS. 24-27 show various stages of a method for installing a closure system in accordance with an embodiment of the technology.

FIGS. 24-27 show various stages of a method for installing a closure system in accordance with an embodiment of the technology. Referring now to FIG. 24, the debris cap assembly 600 has been inserted into the pipe 604 such that the lower plate 683 rests on a feature 773 of the pipe 604. The feature 773 can be a ledge, flange, collar, or other suitable feature upon which the debris cap assembly 600 can rest. To lower the cap 606 (indicated by arrow 952) to close an end of the pipe 604, the locking mechanism 637 can be in an unlocked state. The locking mechanism 637 can have a fastener 960 and a stop 961. The fastener 960 can be operated to change the locking mechanism 637 between a locked state and an unlocked state. The fastener 960 can include one or more pins, screws, bolts, or the like.

Figure 25:
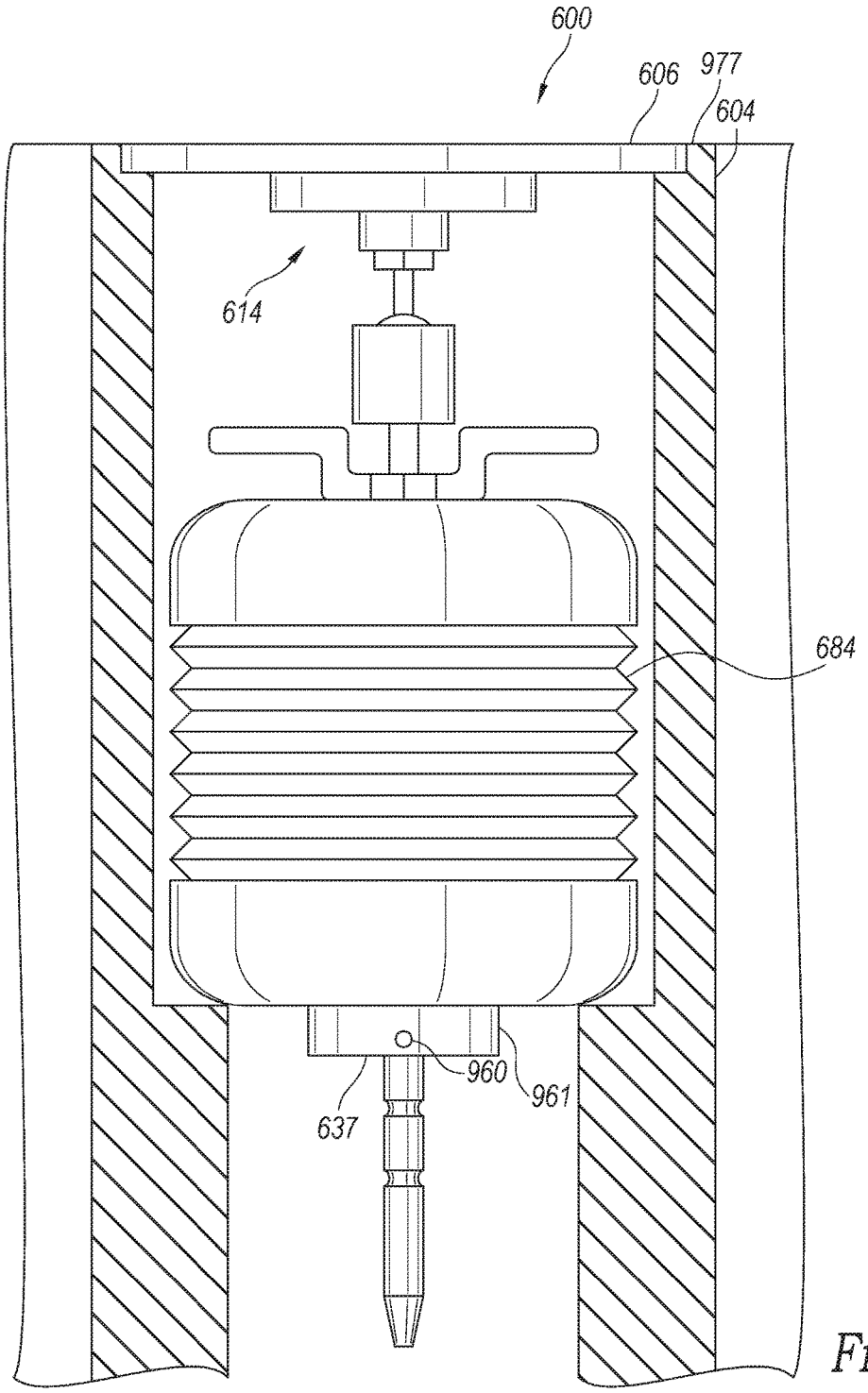

FIG. 25 shows the debris cap assembly 600 after the cap holder 614 has been lowered to seat the cap 606 at the end 977 of the pipe 604. Once seated, the fastener 960 can be operated to change the locking mechanism 637 to a locked state. To fix the debris cap assembly 600 to the pipe 604, the member 684 can be radially expanded against the pipe 604.

Figure 26:
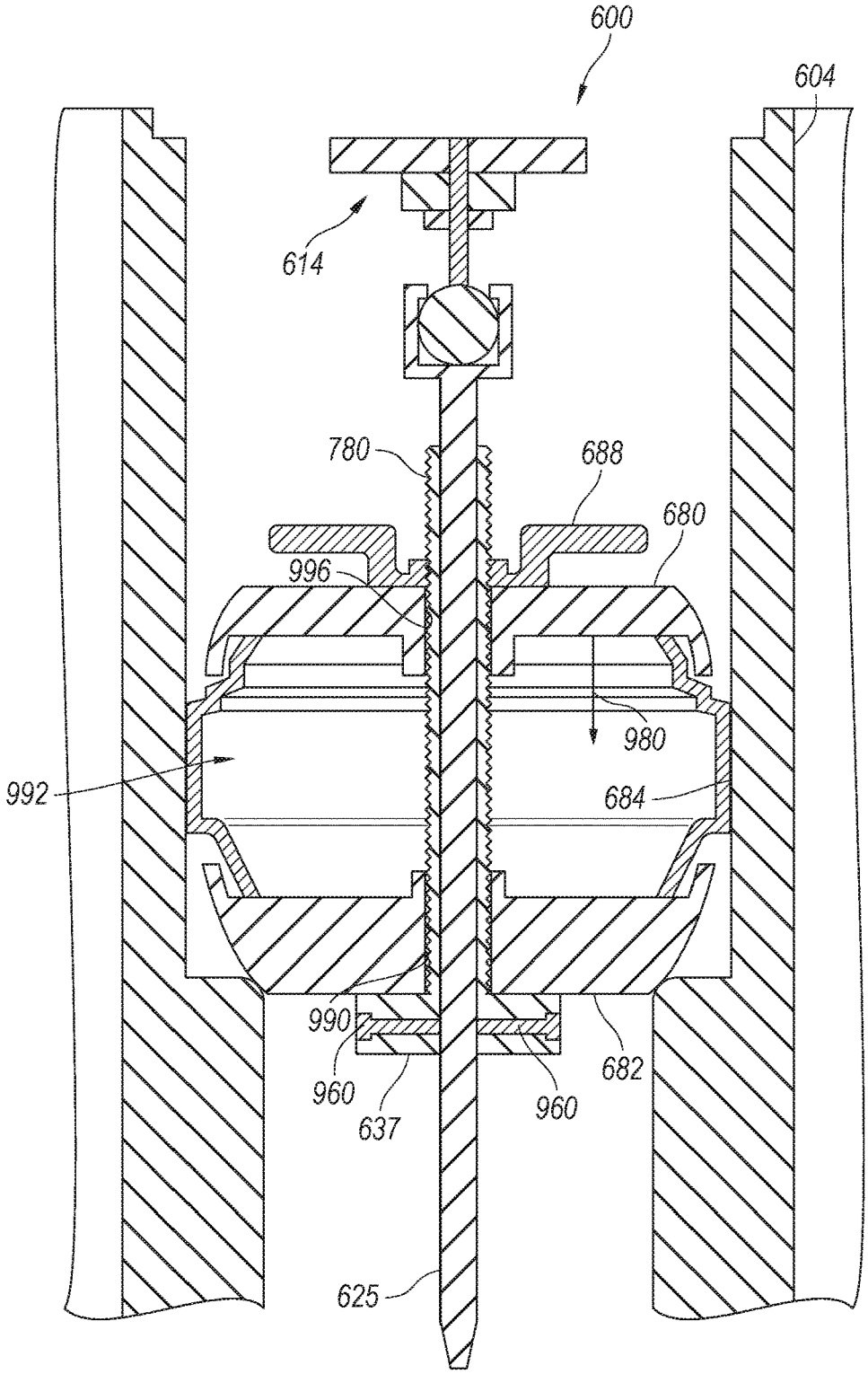

FIG. 26 is a side cross-sectional view of the debris cap assembly 600 secured to the pipe 604. The adjuster 688 can be rotated to drive the upper plate 680 towards the lower plate 682, as indicated by arrow 980, to adjust the level of compression. The fasteners 960 of the locking mechanism 637 can securely hold the shaft 625 to prevent displacement of the lower plate 682. The shaft 780 can extend through an opening 990 of the lower plate 682, a central passageway 992 of the expandable member 684, and the aperture 996 and the upper plate 680. This allows relatively high compressive stresses to be applied to the expandable member 684 while keeping the components assembled together.

Figure 27:
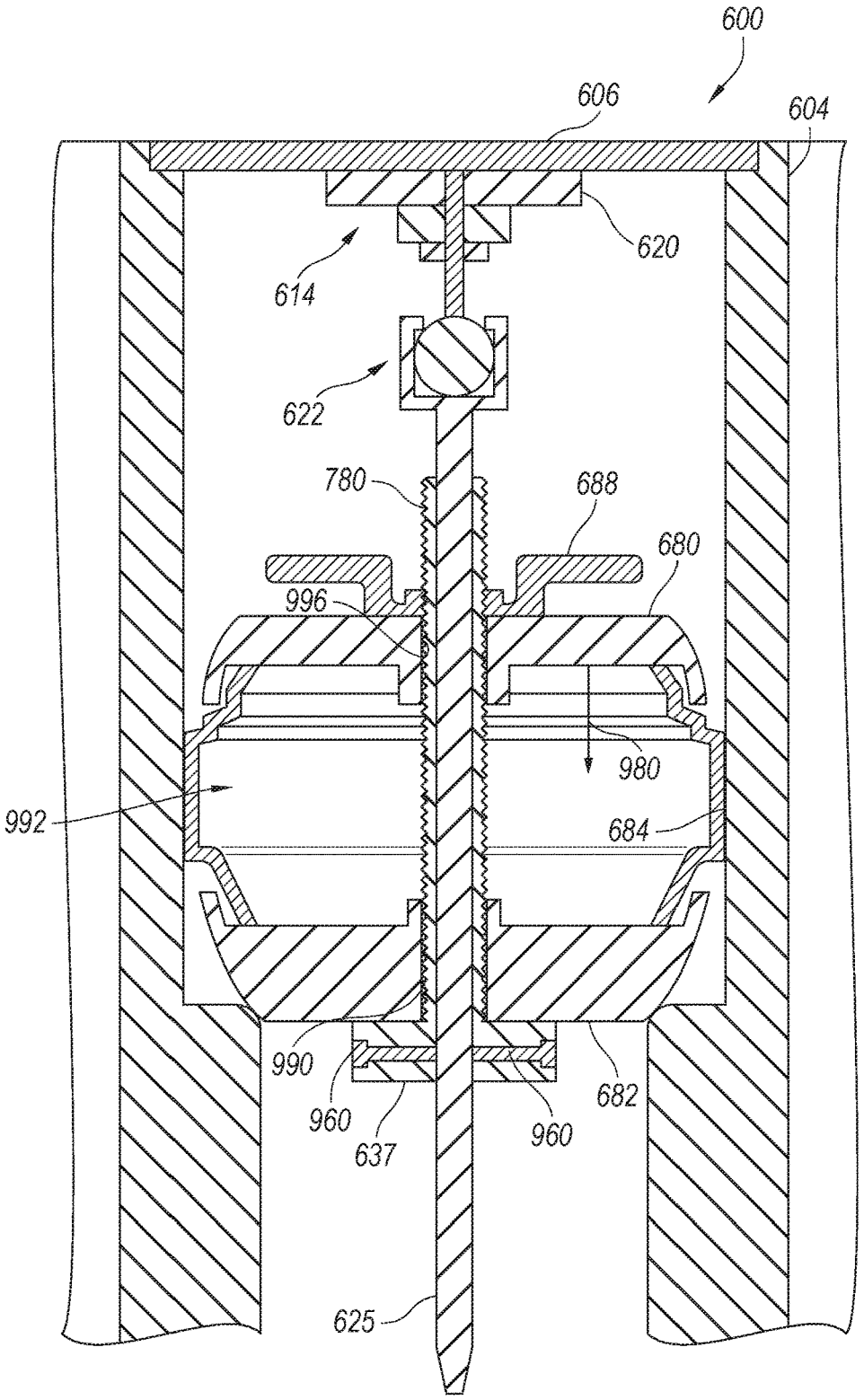

FIG. 27 is a cross-sectional view of the debris cap assembly 600 after the cap 606 has been placed on the magnetic element 620. The vertical position of the cap 606 can be adjusted by removing the debris cap assembly 600 and changing the position the shaft 625. The debris cap assembly 600 can then be placed back in the pipe 604.

To access a pipe, the cover 606 can be lifted away from the holder 620. The adjuster 688 can be operated to allow the expandable member 684 to push apart the plates 680, 682. After the expandable member 684 has disengaged pipe, the debris cap assembly 600 can be can conveniently lift out of the pipe 604. The debris cap assembly 600 can be reinstalled while the cap holder 614 remains in the same configuration. If the cap 606 is replaced with another cap, the configuration of the debris cap holder 614 can be adjusted based on the dimensions (e.g., thickness of the new cap). This allows a wide range of caps to be utilized with the debris cap assembly 600.

The debris cap assembly 600 can be periodically inspected and adjusted as needed. For example, the mechanical characteristics of the expandable member 684 may change over time because some materials may harden whereas others may soften. The cover 606 can be removed to inspect the expandable member 684 and other components of the debris cap assembly 600. The adjuster 688 can be used to adjust the level of expansion of the member 684 to achieve the desired fit. If the debris cap assembly 600 has reached its end-of-life, can be replaced with another debris cap assembly. Alternatively, worn components can be easily replaced as desired. After performing maintenance and inspection, the debris cap assembly 600 can be left in place and the cover can be reapplied.

Figure 28:
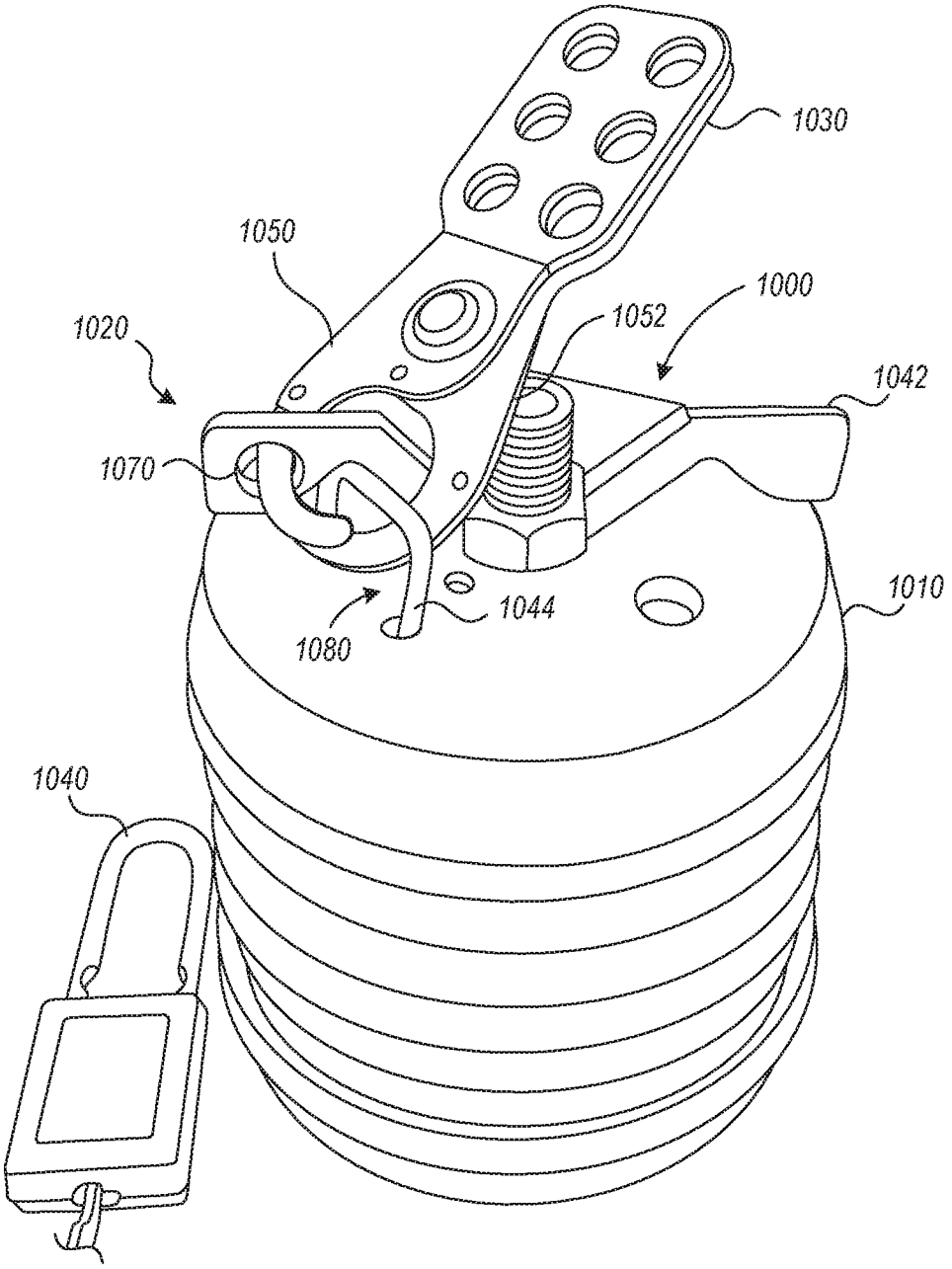
FIG. 28 is an isometric view of a closure system in accordance with an embodiment of the present technology.

FIG. 28 is an isometric view of a closure system 1000 in accordance with an embodiment of the present technology. (A cap holder is not shown.) The closure system 1000 has a locked configuration and an unlocked configuration and can include a debris cap assembly 1010 ("debris cap assembly 1010") and a lock assembly 1020. In the locked configuration, the closure system 1000 can remain securely coupled to a structure in which it is installed. In the unlocked configuration, the closure system 1000 can be removed, adjusted, and/or otherwise altered. The relevant description of the debris cap assemblies discussed in connection with FIGS. 1-27 applies equally to the debris cap assembly 1010.

The lock assembly 1020 in a locked configuration can keep the debris cap assembly 1010 in the installed configuration and can serve as an anti-tampering device. To remove or reconfigure the debris cap assembly 1010, the lock assembly 1020 can be unlocked. The lock assembly 1020 can include a lockout hasp 1030 and lock 1040. The lockout hasp 1030 can be configured to engage an adjuster 1042 and a deployable lockout feature 1044. In some embodiments, the lockout hasp 1030 has arms 1050, 1052 that pass through an opening 1070 and an opening 1080 of the lockout feature 1044. The lockout feature 1044 can be lowered from the illustrated raised position to allow rotation of the adjuster 1042. In other embodiments, the adjuster 1042 and lockout feature 1044 can be coupled together using the lock 1040, which can be a pad lock or other type of lock.

Lock assemblies can be incorporated into or used with other closure systems, cap holder devices, and other components disclosed herein. The systems disclosed herein can be used in a wide range of applications. For example, the closure systems and components disclosed herein can be used with different types of closures. The systems, assemblies, and devices disclosed herein can be installed in, for example, pressurized or non-pressurized conduits (e.g., water pipes, sewer pipes), lines (e.g., hydraulic lines), fittings, and/or access openings. It will be appreciated that some well-known structures or functions may not be shown or described in detail so as to avoid unnecessarily obscuring the relevant description of the various embodiments. The order of steps of the methods disclosed herein can be varied. For example, the closure holder devices (e.g., cap closure devices) disclosed herein can be configured before or after installing the holder device. Furthermore, features, structures, or characteristics of various embodiments may be combined in any suitable manner. For example, the cap 106 of FIG. 1 can include one or more features of the cap 400 of FIG. 14, or features of the cap 450 of FIG. 15. The closures disclosed herein can also be in the form of a wide range of different devices suitable for covering different types of structures. Accordingly, systems, apparatuses, assemblies, and methods disclosed herein can be used with or modified to be used with a wide range of closures (e.g., flat lids, hinge covers, caps, and the like).

While advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. The term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. As used herein, the terms "vertical," and "horizontal" refer to the relative directions or positions of features disclosed herein in view of the orientation shown in the figures. The disclosed features, however, can be installed at other orientations and locations.

In general, in the following claims, the terms used should not be construed to limit the claims to the specific embodiments disclosed in the specification and the claims, but should be construed to include all possible embodiments, along with the full scope of equivalents to which such claims are entitled. Accordingly, the claims are not limited by the disclosure.

What is claimed is:

1. A debris cap assembly comprising:

a cap holder device configured to be positioned in an end of a conduit positioned along a roadway, the cap holder device including a plug member, and a cap holder carried by the plug member, the cap holder including a magnetic element and a connector, wherein the connector is configured to connect the magnetic element to the plug member such that the magnetic element is movable relative to the plug member so as to position the magnetic element for releasably holding a cap that covers the end of the conduit when the plug member is positioned in the conduit, wherein the connector includes a joint that allows rotation of the magnetic element relative to the plug member.

2. The debris cap assembly of claim 1, wherein the connector includes a threaded rod that defines an axis of rotation, wherein the magnetic element can be rotated about the axis of rotation in a first direction to move the magnetic element away from the plug member, and in a second direction about the axis of rotation to move the magnetic element toward the plug member.

3. The debris cap assembly of claim 1, wherein the cap holder can be operated to raise and lower the magnetic element while the plug member is positioned in the end of the conduit.

4. The debris cap assembly of claim 1, further comprising a ferromagnetic cap configured to cover the end of the conduit while being magnetically coupled to the magnetic element.

5. The debris cap assembly of claim 1, further comprising a cap configured to cover the end of the conduit, the cap including one or more magnets for magnetically coupling to the magnet element.

6. The debris cap assembly of claim 1, wherein the magnetic element includes a permanent magnet.

7. The debris cap assembly of claim 1, further comprising one or more nuts that are rotatable to increase or decrease pressure applied by the plug member to the conduit.

8. The debris cap assembly of claim 1, wherein the joint is a ball and socket joint.

9. The debris cap assembly of claim 1, wherein the connector includes a first end, a second end, and a main body extending therebetween, wherein the first end is connected to the magnetic element, and wherein the second end is positioned to be located within a passageway of the conduit when the plug member is positioned in the conduit.

10. The debris cap assembly of claim 9, wherein the plug member includes an upper plate, a lower plate, and a sealing member between the upper and lower plates.

11. The debris cap assembly of claim 10, further including one or more nuts threadably engaging the connector and movable to cause the upper and lower plates to compress the sealing member.

12. A closure assembly installable in a conduit, comprising:

a closure holder device configured to be positioned within an end portion of a conduit and including a plug assembly and a closure holder connected to the plug assembly, wherein the closure holder includes a retention element that is movable away from or toward the plug assembly to position a closure, which is magnetically coupled to the retention element, at the end portion of the conduit, wherein the closure holder device includes a pivot device that allows rotation of the retention element relative to the plug member.

13. The debris cap assembly of claim 12, wherein the closure holder device includes a deployable lockout feature configured to keep the plug member in an installed configuration.

14. The closure assembly of claim 12, wherein the plug assembly includes an annular member configured to fit in an opening of the conduit to obstruct a passageway of the conduit.

15. The closure assembly of claim 12, wherein the closure holder includes a connector that extends from the plug assembly to the retention element, wherein the retention element includes a magnetic disc.

16. The closure assembly of claim 12, further comprising a magnetic or ferromagnetic closure configured to cover the end portion of the conduit.

17. The closure assembly of claim 12, wherein the plug assembly includes a compressible plug member movable along a connector of the retention element.

18. A debris cap assembly, comprising:

a cap holder device including a plug assembly having a delivery configuration and an expanded configuration, and a cap holder movably coupled to the plug assembly to position a cap held by the cap holder at different positions while the plug assembly is in the expanded configuration, the cap holder including a magnetic element and a hinge that allows rotation of the magnetic element relative to the plug assembly.

19. The debris cap assembly of claim 18, wherein the plug assembly includes an adjustor and an expandable member having a first configuration and a second configuration, wherein the adjustor is operable to move the expandable member between the first configuration and the second configuration.

20. The debris cap assembly of claim 19, wherein the plug assembly includes a first endcap and a second endcap movable towards one another to expand the plug assembly.

21. The debris cap assembly of claim 19, wherein the plug assembly is configured to expand radially outward while the cap holder is stationary relative to a portion of the plug assembly.

22. The debris cap assembly of claim 18, wherein the plug assembly includes at least one rod extending through an expandable member and connected to the cap holder; and an adjustor selectively moveable along the at least one rod to cause the expandable member to expand outwardly.

23. The debris cap assembly of claim 22, wherein the at least one rod has external threads that threadably engage internal threads of the adjustor.

24. The debris cap assembly of claim 22, further comprising locking assembly operable to adjust the position of the plug assembly along the at least one rod.

25. The debris cap assembly of claim 22, wherein the at least one rod includes a tubular member and a shaft extending through the tubular member, wherein the tubular member threadably engages the adjustor, and wherein the shaft has a plurality of plug assembly positioning features.

26. The debris cap assembly of claim 25, wherein the tubular member and the shaft are coaxial.

27. A method for covering an opening along a roadway or sidewalk, the method comprising:

inserting a plug assembly of a debris closure assembly into the opening; and positioning a magnetic element of the debris closure assembly relative to the plug assembly such that the magnetic element is positioned to magnetically hold a closure covering the opening, wherein the debris closure assembly includes a hinge that allows rotation of the magnetic element relative to the plug assembly.

28. The method of claim 27, further comprising compressing the plug assembly to cause the plug assembly to be pressed against a sidewall of a conduit surrounding the plug assembly.

29. The method of claim 27, further comprising locking the debris closure assembly such that the plug assembly is in an expanded configuration.

30. The method of claim 27, further comprising rotating the magnetic element about an axis of rotation relative to the plug assembly to move the magnetic element.

31. The method of claim 30, wherein rotating the magnetic element about the axis of rotation relative to the plug assembly raises or lowers the magnetic element.

32. A debris cap assembly comprising:

a cap holder device installable in an end of a conduit and including means for plugging the conduit in which the cap holder device is positioned, and a cap holder connected to the means for plugging the conduit and including means for releasably holding a cap, and means for connecting the means for releasably holding the cap to the means for plugging the conduit such that the cap is movable relative to the means for plugging so as to position the cap holder for releasably holding the cap at an end of the conduit when the cap holder device is positioned in the conduit, wherein the means for connecting includes a ball and socket joint.

33. The debris cap assembly of claim 32, wherein the means for plugging a conduit includes an expandable plug member.

34. The debris cap assembly of claim 32, wherein the means for releasably holding the cap includes one or more magnetic elements.

35. A closure system, comprising:

a cap holder device having a locked state for securing the cap holder device to a conduit and an unlocked state for releasing the cap holder device from the conduit, the cap holder device including a plug member, and a cap holder carried by the plug member for releasably holding a cap that covers an opening of a conduit when the cap holder device is positioned in the conduit, wherein the cap holder includes a magnetic element and a pivotable joint assembly that allows rotation of the magnetic element relative to the plug member.

36. The closure system of claim 35, wherein the magnetic element is movable relative to the plug member while magnetically holding the cap.

37. The closure system of claim 35, wherein the cap holder device is operable to cause the plug member to move from an unexpanded configuration to a second expanded configuration, wherein the cap holder device in the locked state is configured to keep the plug member in the second expanded configuration.

38. The closure system of claim 35, wherein the cap holder device includes a lock assembly coupling together at least two parts of the closure system to prevent operation of the cap holder device that cause the plug member to collapse.

39. The closure system of claim 9, further comprising a lockout feature.

40. The closure system of claim 35, wherein the pivotable joint assembly is a ball and socket joint.

* * * * *